US009463623B2

(12) United States Patent
Takagi et al.

(10) Patent No.: US 9,463,623 B2
(45) Date of Patent: Oct. 11, 2016

(54) LIQUID EJECTION HEAD AND IMAGE FORMING APPARATUS INCORPORATING SAME

(71) Applicants: Daisuke Takagi, Kanagawa (JP); Hisashi Habashi, Kangawa (JP); Tomoyuki Aratani, Kangawa (JP); Tatsuya Sameshima, Kangawa (JP); Shinichi Kakuda, Kanagawa (JP); Keisuke Hayashi, Kangawa (JP); Juichi Furukawa, Kangawa (JP)

(72) Inventors: Daisuke Takagi, Kanagawa (JP); Hisashi Habashi, Kangawa (JP); Tomoyuki Aratani, Kangawa (JP); Tatsuya Sameshima, Kangawa (JP); Shinichi Kakuda, Kanagawa (JP); Keisuke Hayashi, Kangawa (JP); Juichi Furukawa, Kangawa (JP)

(73) Assignee: RICOH COMPANY, LTD., Tokyo (JP)

( * ) Notice: Subject to any disclaimer, the term of this patent is extended or adjusted under 35 U.S.C. 154(b) by 200 days.

(21) Appl. No.: 14/203,778

(22) Filed: Mar. 11, 2014

(65) Prior Publication Data

US 2014/0267497 A1 Sep. 18, 2014

(30) Foreign Application Priority Data

Mar. 14, 2013 (JP) ..... 2013-052466
Nov. 11, 2013 (JP) ..... 2013-232651

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1642* (2013.01); *B41J 2/1646* (2013.01)

(58) Field of Classification Search
CPC .... B41J 2/335; B41J 2/33525; B41J 2/3353; B41J 2/3359; B41J 2/33535; B41J 2/33505; B41J 2/164; B41J 2/1648; B41J 2/1606; B41J 2/1642; B41J 2/1632; B41J 2/47; B41J 2/14; B41J 2/1623; H01L 21/0228; H01L 21/02581; G03G 15/043; G02B 26/123; H04N 1/113
See application file for complete search history.

(56) References Cited

U.S. PATENT DOCUMENTS

| | | | | |
|---|---|---|---|---|
| 5,563,640 | A * | 10/1996 | Suzuki | 347/45 |
| 2002/0063766 | A1* | 5/2002 | Yoshizawa et al. | 347/100 |
| 2002/0089573 | A1* | 7/2002 | Yun | 347/68 |
| 2009/0135356 | A1* | 5/2009 | Ando | 349/137 |
| 2011/0074871 | A1* | 3/2011 | Uchiyama | 347/28 |
| 2011/0273518 | A1* | 11/2011 | Sato et al. | B41J 2/161 347/68 |
| 2012/0026236 | A1* | 2/2012 | Fujii | 347/20 |
| 2012/0274707 | A1* | 11/2012 | Cai et al. | 347/47 |
| 2012/0314007 | A1* | 12/2012 | Shimofuku et al. | 347/71 |
| 2013/0063525 | A1* | 3/2013 | Sieber | 347/45 |
| 2013/0252434 | A1* | 9/2013 | Yuasa et al. | 438/758 |

FOREIGN PATENT DOCUMENTS

| | | |
|---|---|---|
| JP | 10-071721 | 3/1998 |
| JP | 2004-098310 | 4/2004 |
| JP | 2009-046541 | 3/2009 |
| JP | 2009-113302 | 5/2009 |
| JP | 2011-074395 | 4/2011 |
| JP | 2012-091381 | 5/2012 |

* cited by examiner

*Primary Examiner* — Matthew Luu
*Assistant Examiner* — Patrick King
(74) *Attorney, Agent, or Firm* — Cooper & Dunham LLP

(57) ABSTRACT

A liquid ejection head includes channel forming members and a surface treatment film. The channel forming members are joined to each other via an adhesive agent to form a channel for liquid. The surface treatment film is formed on a surface of at least one of the channel forming members. The surface treatment film is an oxidized film including Si. The oxidized film further includes a transition metal forming a passive film.

12 Claims, 9 Drawing Sheets

LIQUID EJECTION HEAD AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2013-052466, filed on Mar. 14, 2013, and 2013-232651, filed on Nov. 11, 2013, in the Japan Patent Office, the entire disclosure of each of which is hereby incorporated by reference herein.

BACKGROUND

1. Technical Field

Embodiments of this disclosure relate to a liquid ejection head and an image forming apparatus incorporating the liquid ejection head.

2. Description of the Related Art

Image forming apparatuses are used as, for example, copiers, printers, facsimile machines, and multi-functional devices having at least one of the foregoing capabilities. As one type of image forming apparatus, for example, an image forming apparatus employing a liquid ejection recording method is known to use a recording head including a liquid ejection head (droplet ejection head) for ejecting droplets of ink, such as an ink-jet recording device. In the liquid ejection head, channels for liquid (ink channels) are formed by joining members for forming the channel (hereinafter referred to as "channel-forming members") with each other via an adhesive agent. In this case, its bonding interface (joint interface) is a very small region. However, since the region is exposed to ink, the region needs to have a bonding function to prevent peeling-off of the channel-forming members from each other even when the region is in a liquid-contacting state in which the region contacts the ink.

When the channel-forming members or other ink-contacting members are eluted out and swelled due to for example, ink, the image forming apparatus is largely changed in liquid-jetting property so that an image quality can not be maintained satisfactorily.

Thus, the following has been performed: a surface treatment film is formed onto the front surface of the channel-forming members, this film being capable of improving the front surface in adhesiveness; or the front surface of the channel-forming members is activated by irradiation with plasma.

Known are, for example, a technique of forming, as the surface treatment film, an organic film made of, for example, polyimide or polyparaxylene (JP-2012-091381-A); and a technique of forming, as the surface treatment film, a $SiO_2$ film (JP-2004-098310-A).

Known is also a member that has a substrate (base material) and a joint film and can be joined with an opposite substrate (another adherend), in which: the joint film contains a metal atom and an oxygen atom bonded to the metal atom; an eliminating group that is bonded to at least one of the metal atom and the oxygen atom is introduced into the vicinity of the front surface of the joint film; and by radiation of ultraviolet rays thereto, the eliminating group present in the vicinity of the front surface is eliminated from at least one of the metal atom and the oxygen atom so that the joint film can exhibit, onto the front surface thereof, adhesiveness onto the opposite substrate (JP-2009-046541-A).

As disclosed in JP-2012-091381-A, however, when an organic film is used as the surface treatment film, the organic film may not fully block the permeation of water. Thus, a material that is not easily corroded with ink or the like is used for the channel-forming members.

In addition, the $SiO_2$ film as the surface treatment film is converted into a hydroxide by a strongly alkaline liquid, so that the film is easily ionized to be eluted out into the liquid. As a result, the channel-forming members of the film may be damaged.

A metal, such as Ni or Ti, or an alloy material, such as stainless steel (SUS), may be used for the surface treatment film. However, when the film contacts an acidic liquid, the film is oxidized and often easily ionized. Use of a material that is not easily dissolved, such as SUS, may reduce a bonding performance thereof to an adhesive agent.

BRIEF SUMMARY

In at least one embodiment of this disclosure, there is provided a liquid ejection head including channel forming members and a surface treatment film. The channel forming members are joined to each other via an adhesive agent to form a channel for liquid. The surface treatment film is formed on a surface of at least one of the channel forming members. The surface treatment film is an oxidized film including Si. The oxidized film further includes a transition metal forming a passive film.

In at least one embodiment of this disclosure, there is provided an image forming apparatus including the above-described liquid ejection head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
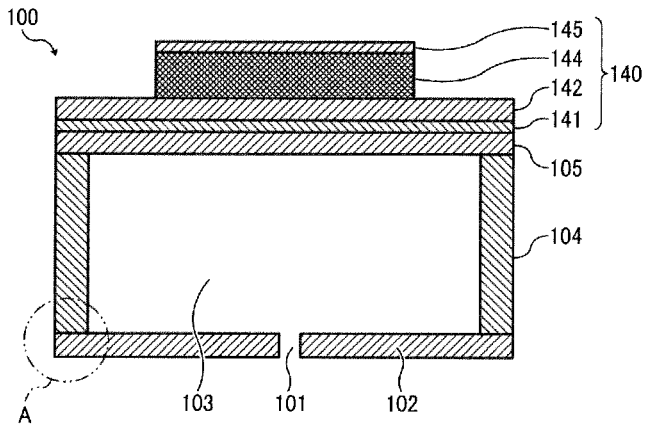
FIG. 1 is a sectional view of a liquid ejection head according to a first embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, it will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

For example, in this disclosure, the term "sheet" used herein is not limited to a sheet of paper and includes anything such as overhead projector (OHP) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, wood, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the disclosure and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

First, a first embodiment of a liquid ejection head according to the invention is described with reference to FIG. 1. FIG. 1 is a sectional view of the head.

In the liquid ejection head, which is a head 100, the following are stacked onto each other: a nozzle plate 102 in which a nozzle 101 for ejecting droplets is formed; a channel plate 104 that forms a channel (pressure chamber) 103 to which the nozzle 101 is connected; and a vibrating plate 105 that forms a wall of the pressure chamber 103. The nozzle plate 102, the channel plate 104, and the vibrating plate 105 are channel-forming members, which are jointed to each other via an adhesive agent to form the channel.

A piezoelectric actuator including an electromechanical transducer element 140 is provided onto the surface of the vibrating plate 105 that is opposite to the pressure chamber 103 surface side of the plate 105.

The electromechanical transducer element 140 is an element in which on the vibrating plate 105, an oxide electrode 141 as a close adhesion layer, a first electrode (lower electrode) 142, an electromechanical transducer film 144, and a second electrode (upper electrode) are successively stacked.

The first electrode 142 and the second electrode 145 are each made of, for example, a material high in electroconductivity, such as Pt or Au. The electromechanical transducer film 144 is made of lead zirconate titanate (PZT). The channel plate 104 is made of silicon; and the nozzle plate 102 is made of, for example, stainless steel (SUS), nickel or polyimide.

Figure 2:
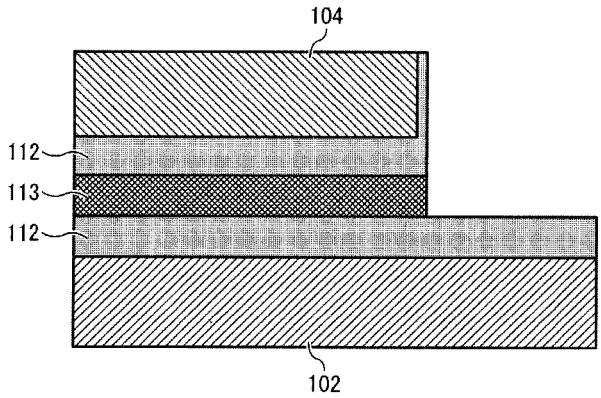
FIG. 2 is an enlarged sectional view of an example of a region A in FIG. 1.
Figure 3:
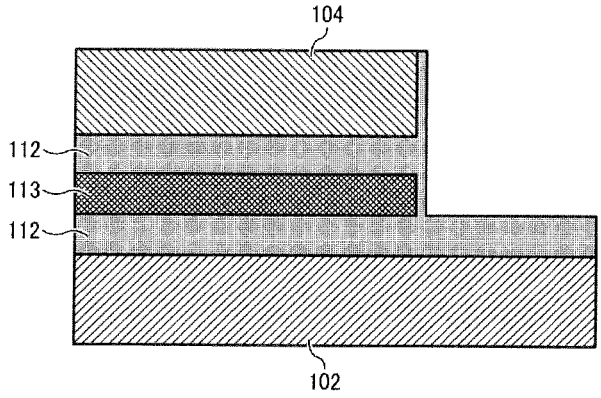
FIG. 3 is an enlarged sectional view of another example of the region A in FIG. 1.

The following will describe details of an adhesive agent-jointed portion of the liquid ejection head 100 with reference to FIGS. 2 and 3. FIGS. 2 and 3 are enlarged sectional views of different examples of a region A in FIG. 1.

The nozzle plate 102 and the channel plate 104 are joined to each other through an adhesive agent 113.

On each of the opposed surfaces of the nozzle plate 102 and the channel plate 104, which include surface areas to be bonded to each other via the adhesive agent 113, a surface treatment film 112 is formed. FIG. 2 is an example in which the surface treatment film 112 is not formed on an exposed surface of the adhesive agent 113. FIG. 3 is an example in which the surface treatment film 112 is formed on the exposed surface of the adhesive agent 113. The form in FIG. 3 is obtained, for example, by using a method making use of a surface reaction, such as an atomic layer deposition (ALD) process, to form the surface treatment film 112 after the nozzle plate 102 is bonded to the channel plate 104.

The surface treatment film 112 is an oxidized film containing Si. The oxidized film contains a transition metal that forms a passive film.

The surface treatment film 112 is a composite oxidized film of Si, which is high in reliability against ink and improves the adhesiveness between the transition metal species, which can form a passive film, and the adhesive agent 113.

Since the adhesive agent 113 is a thin film of an organic substance, the adhesive agent 113 transmits water. Thus, when the surface treatment film 112 has no reliability against ink, the ink corrodes, through the adhesive agent 113, the surface treatment film 112, so that the surface treatment film 112 is peeled off together with the adhesive agent 113.

However, the transition metal species can form a stable oxide so that the species can keep a stable state even in an aqueous solution; thus, the species can have resistance against ink.

The Si-containing oxidized film is good in compatibility with any anionic curing agent and silane coupling agent contained in the adhesive agent 113, thereby improving the adhesiveness between the surface treatment film 112 and the adhesive agent 113.

As described above, the surface treatment film is formed on the front surface of the channel-forming members; the surface treatment film is an oxidized film containing Si; and the oxidized film contains the transition metal, which can form a passive film. This structure makes it possible to make the following compatible with each other: an improvement in adhesiveness in the interface between the surface treatment film 112 and the adhesive agent 113, and an improvement in reliability against ink in the interface.

In other words, the surface treatment film contains $SiO_2$, thereby being high in close adhesiveness onto other members, and also regarding the adhesiveness of this film onto the adhesive agent, an adhesive force high in water resistance can be ensured by the use of the amine-based curing agent and the silane coupling agent. Additionally, by forming the passive film, a stable corrosion-resistant film is formed onto the front surface of the surface treatment film 112. As a result, the channel-forming members are stable over a long term even when brought into contact with liquid.

When any transition metal has, out of inner-shell orbitals such as d and f orbitals, an empty orbital, the metal can have plural oxidation numbers. For this reason, when the surface treatment film 112 contains the transition metal species, the corresponding performance of the whole of the film to the oxidation number is improved so that the film becomes large in permissible-range against an excess or deficiency of oxygen atoms. Thus, the film shows high stability against any deficiency or excess of the oxidation number in the film.

When the surface treatment film 112 contains no transition metal, a defect is generated in the surface treatment film 112 by an excess or deficiency of oxygen atoms. Since the defect is high in energy state, this film is easily dissolved. By contrast, when the surface treatment film 112 contains the transition metal, defects of the surface treatment film can be decreased so that the oxidized film is raised in stability, and the solubility of the surface treatment film in liquid can be decreased.

By use of a metal that can form a passive film, such as a bulb metal, out of such transition metals, the solubility of the surface treatment film 112 can be further decreased.

The metal, which forms a passive film, is preferably a transition metal high in corresponding performance to the oxidation number, examples thereof including tantalum, niobium, titanium, hafnium, zirconium, and tungsten.

Tantalum, niobium, hafnium and zirconium each form a very stable oxidized film even though the pH of a liquid contacting the metal is acidic or alkaline. Thus, these metals have the advantage that a film thereof can keep a film state even though the pH is acidic or alkaline.

In other words, it is preferred that the surface treatment film 112 contains the transition metals in the Groups 4 and 5, which can each form a passive film. The transition metals in the Groups 4 and 5, which can each form a passive film, have an electron orbital similar to that of Si belonging to the Group 4. By introducing the transition metal into a $SiO_2$ film, Si can be strongly bonded through O to the metal species, so that the packing degree of the film is improved. Thus, the film can be made dense.

By Si—O bonds as well as the improvement in the packing degree, strong bonds are allowed to be present in the surface treatment film, whereby a corrosion reaction of the film can be restrained when the film contacts liquid. This makes it possible to form an oxidized film resistant against liquid, so that the surface treatment film can ensure sufficient resistance. Thus, the head can be improved in reliability.

In this case, it is preferred that the surface treatment film contains at least one of Hf, Ta, and Zr as the metal(s) in the Groups 4 and 5, which can each form a passive film.

By introducing at least one of Hf, Ta and Zr into the $SiO_2$ film, the transition metal species is/are very strongly bonded to O to form a passive film. At this time, by allowing the function of the passive film to be present in the surface treatment film 112 as well as by improving the packing degree of the film 112, a corrosion reaction can be intensely restrained when the surface treatment film contacts both of an acid liquid and an alkaline liquid. This makes it possible to form an oxidized film resistant against acidic and alkaline liquids.

It is also preferred that the surface treatment film 112 is completely oxidized. This makes it possible to make the crystalline structure of the surface treatment film 112 amorphous. Thus, when the surface treatment film is exposed to liquid, grain boundaries of crystal, which are easily corroded, are hardly present so that the film exhibits a high resistance against the liquid.

It is also preferred that Si is contained in the surface treatment film 112 in a proportion of 17 atomic % or more. When Si is contained in the surface treatment film 112 in a proportion of 17 atomic % or more, a completely transparent film can be formed. The proportion is preferably 20 atomic % or more.

This makes it possible to form an even film in which the metal species is/are rarely distributed unevenly even when the species is/are in an amorphous state. Thus, a local presence of crystal and others can be avoided, and local portions weak against liquid can be decreased. If the Si content by percentage is small in the film, the other metal species is/are aggregated and crystallized so that the film is unfavorably made uneven in quality. If the film is uneven, a battery effect is produced between Si and the other metal species when the film contacts liquid. As a result, a corrosion reaction may be caused.

Whether or not an alloy film that forms the surface treatment film 112 is completely oxidized can be judged in accordance with whether or not the film can transmit visible rays since the film is in an amorphous state. When the attenuation coefficient (k) thereof is 0.1 or less, preferably 0.03 or less in the wavelength range of 400 to 800 nm according to, for example, a multi-wavelength type ellipsometer, it can be determined that the film is completely oxidized.

It is preferred that the transition metal(s) is/are contained in the surface treatment film 112 in a proportion of 2 atomic % or more. This makes it possible to certainly improve the density of the surface treatment film 112 and to improve resistance against liquid. The proportion is more preferably 3.5 atomic % or more and 13.5 atomic % or less. This makes it possible for the surface treatment film 112 to have a structure in which the number of defects is small and the filling rate is high, so that resistance against ink can be gained easily.

The method for checking the state of the film may be a method of using an ellipsometer to check whether or not the refractive index thereof is a constant value. For example, the refractive index of a $SiO_2$ film is 1.4, and that of a $Ta_2O_5$ film is 2.1 when the film is a monolayered film. Thus, when the surface treatment film 112 is completely oxidized, the refractive index of the surface treatment film 112 is a value from 1.4 to 2.1. However, when the metal species in the surface treatment film 112 is/are not completely oxidized, the film 112 is lowered in transmittance but raised in refractive index. Therefore, a desired film quality can be gained by controlling both the refractive index and the transmittance.

In other words, when individual metal oxide films constituting the surface treatment film 112 are different from each other in refractive index, the ratio therebetween in the alloy can be controlled through the refractive index. This makes it possible for the film to be measured at a high speed in the atmosphere under nondestructive conditions. Thus, also in an actual mass production process, conditions for the surface treatment films 112 are easily controlled.

The method for forming the surface treatment film 112 may be a vapor deposition, sputtering, chemical vapor deposition (CVD) or ALD method, or the like capable of forming a thin film easily. When the channel-forming members are made of, in particular, a material such that it is deformed by heating treatment, it is preferred to form the film by a sputtering method, or by an ALD method at 160° C. or lower, preferably 120° C. or lower.

In particular, an ALD method is a method of completing a film-forming reaction for each of atomic monolayers; thus, the method makes it possible to form a film far denser and smaller in the number of defects than ordinary CVD and vapor deposition methods. The method also makes it possible to form a film at any gas-absorbable site of a member; thus, the method makes it possible to form a film evenly also onto a member having a vertical wall or an edge.

According to a sputtering (Physical Vapor Deposition: PVD) method, a metal species of a target is sputtered with Ar ions. Thus, a film small in impurity quantity can be formed. Moreover, since the film can be formed on a substrate by sputtering ions of the metal species, the film is high in adhesiveness onto the substrate. Furthermore, since the method uses no reaction heat, the members can be cooled so that a film can be formed even at a temperature close to room temperature. Consequently, even when a material that is not easily raised in temperature is used for the channel-forming members, the members can gain resistance against liquid.

It is also preferred for the channel-forming members that any surface thereof that contacts liquid other than the joining surface is also coated with the surface treatment film 112. According to this structure, a member low in liquid-contact resistance and an adhesive improving material do not elute out easily. Thus, this structure can be a structure high in reliability.

In this case, the film thickness of the surface treatment film 112 is preferably 10 nm or more, more preferably 25 nm or more at its thinnest portion. If the film thickness is too small, a defect of the channel-forming members, when present, is not easily covered with the film 112.

When the surface treatment film 112 is formed on the front surface of the vibrating plate 105 as one of the channel-forming members, it is not preferred that the film 112 is such a thick film that produces an effect onto action characteristics of the vibrating plate 105. Accordingly, the film thickness of the surface treatment film 112 is preferably 200 nm or less, more preferably 50 nm or less.

Figure 4:
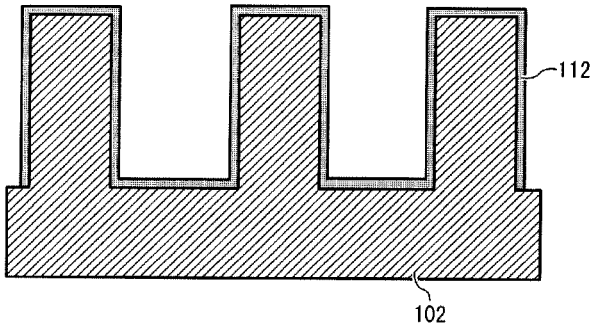
FIG. 4 is a view of an example of a film formed on a member having irregularities according to an atomic layer deposition (ALD) method.

When the surface treatment film 112 having a film thickness as described above is formed onto surfaces of the channel-forming members that are to be channel wall surfaces, it is preferred to form the film by an ALD method at 160° C. or lower, preferably 120° C. or lower, as described above. Any ALD method is a film-forming method controllable at a monomolecular layer level and based on a surface reaction. As illustrated in FIG. 4, therefore, the method makes it possible to form a very even film also onto a member having a vertical wall or an inclined wall.

Figure 5:
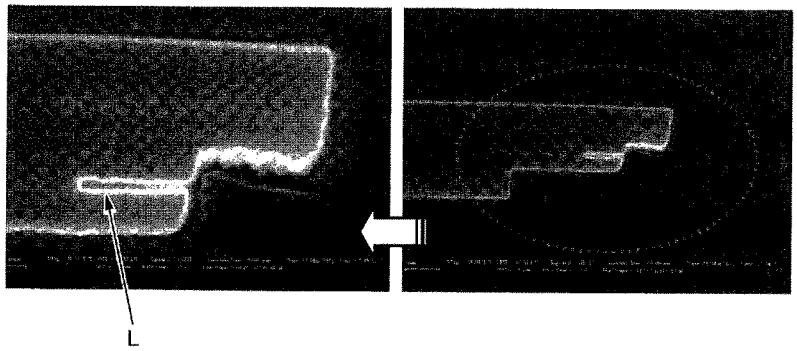
FIG. 5 is a photographic view of an example of a cross section of a sample formed according to an ALD method in which a surface treatment film made of $SiO_2$ to which Ta is introduced is formed on a Si substrate having a channel pattern formed by etching.

FIG. 5 shows an example of an observed cross section of a sample obtained by forming, actually according to an ALD method, a surface treatment film 112 in which Ta was introduced into $SiO_2$ onto a Si substrate in which a channel pattern was formed by etching. As is seen from a bright line L derived from SiTaOx in FIG. 5, it has been verified that the film was evenly formed also onto side walls of the etched pattern.

Usable source gases are different from each other in reactivity in accordance with the kind thereof. When a film is formed at 160° C. or lower, examples of the gases include gases each having, as a functional group to be coordinated around a metal, —$C_2H_5$, —Cl, or —$(N(CH_3)_2)$. In many cases, amino-based gases each having —$(N(CH_3)_2)$ or some other group are excellent in low-temperature reactivity.

A gas to be reacted therewith is generally $O_2$ plasma or $H_2O$. In the case of $O_2$ plasma, the reactivity thereof is high but $O_3$ produced in the plasma decomposes the source gases, so that byproducts are easily generated. In the case of low-temperature treatment at 160° C. or lower, the byproducts easily adhere again onto the inside of the chamber of the device, or the member substrate. This may be a factor of the generation of particles or the deterioration of the yield.

By contrast, regarding $H_2O$, the reaction thereof is only hydrolysis, so that the generation of byproducts can be restrained. At the time of the reaction, OH groups are easily produced on the front surface of the surface treatment film. When a source gas is introduced thereonto in the next film-forming cycle, the adhesion of the source gas onto the substrate can be promoted. $H_2O$ is therefore particularly favorable for low-temperature film-formation. In the case of using, as the source gas, pentadimethylamide tantalum (PDMA-Ta), an even film can be formed even at 80° C. However, the film-forming rate is slow; thus, it is preferred that a batch treatment in which plural members are simultaneously treated is conducted at the time of mass production.

By conducting the low-temperature treatment, the surface treatment film 112 can be formed even onto bonding-finished portions without damaging the adhesive agent layer.

Figure 6:
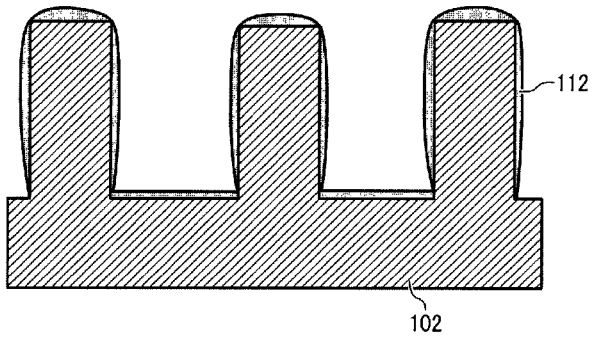
FIG. 6 is a view of an example of a film formed on a member having irregularities according to a sputtering method.

As illustrated in FIG. 6, when a sputtering method is used as the method for forming the surface treatment film 112, in the formation of the film onto a member having a vertical wall or an edge, the film thickness becomes uneven.

The sputtering method makes use of a reactive sputtering method of sputtering a metal target with Ar ions and simultaneously introducing $O_2$ thereto to oxide the metal; thus, impurities are not taken into the surface treatment film 112. Consequently, a pure oxidized film, which is small in impurity quantity, can be formed.

Figure 7:
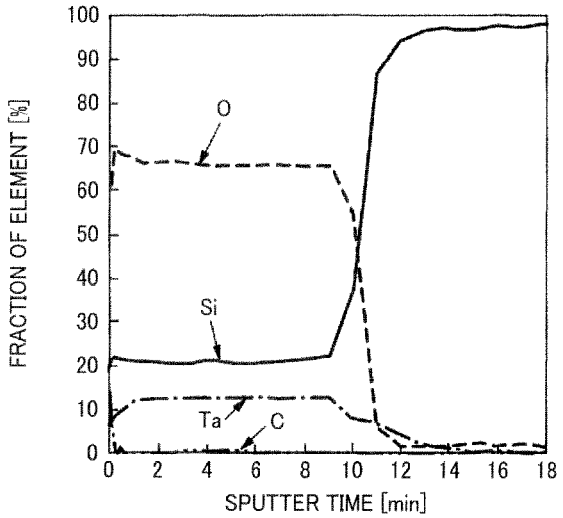
FIG. 7 is a graph of an example of a result obtained by measuring the quantity of impurities through X-ray photoelectron spectroscopy (XPS) in a surface treatment film formed on a Si substrate by a sputtering method.
Figure 8:
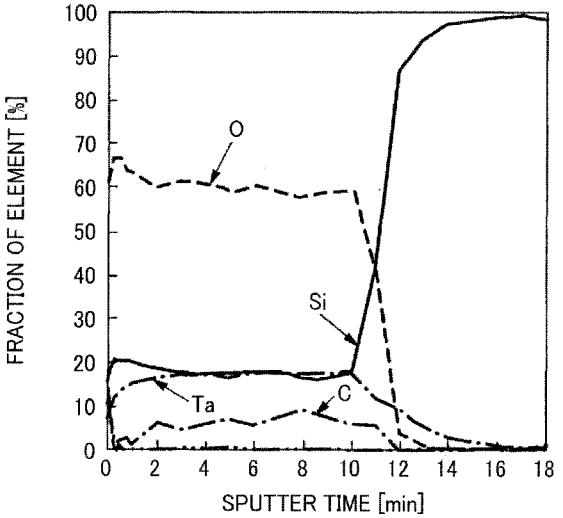
FIG. 8 is a graph of an example of a result obtained by measuring the quantity of impurities through XPS in a surface treatment film formed on a Si substrate by an ALD method.

A comparison made through X-ray photoelectron spectroscopy (XPS) between impurities in a surface treatment film 112 formed on a Si substrate by a sputtering method, and one formed on a Si substrate by an ALD method (at a temperature of 100° C.) is shown in FIG. 7 (the sputtering method) and FIG. 8 (the ALD method).

In the case according to the ALD method, carbon was detected in a proportion of about 5 to 10 atomic % while in the case according to the sputtering method, impurities were not detected at all in the film. Any impurity is easily concentrated at grain boundaries of crystal. Accordingly, when etching of the film is caused by liquid, its portion where impurities are concentrated may possibly become starting points. A film smaller in impurity quantity gains a higher reliability against ink; therefore, even when the film thickness of the surface treatment film is smaller, the film can ensure corrosion resistance.

The following will describe an epoxy adhesive agent, the ink, and the head. Hereinafter, "part(s)" and "%" represent "part(s) by weight" and "% by weight", respectively. The obtained ink-jet heads were evaluated by tests described later.

<Adhesive Agent>

A hydrophilic organic solvent and water as components that constitute the ink permeate the adhesive agent 113 and the bonding interface, so that peeling is promoted to lower the bonding strength. It is therefore important to restrain the permeation of the ink into the adhesive agent 113. In order to restrain the permeation of the ink, it is necessary, from the viewpoint of the structure after the adhesive agent is cured, to improve the density of the adhesive agent 113 to restrain the adhesive agent 113 from being swelled while it is necessary from a chemical viewpoint to make the composition of the adhesive agent immiscible with the ink to prevent the permeation.

The epoxy adhesive agent attains bonding by three-dimensional crosslinkage of its epoxy groups. Thus, the adhesive agent is characterized by being higher in crosslinkage density than other adhesive agents 113 not to be easily swelled. For this reason, this adhesive agent is an adhesive 113 effective against conventional aqueous inks.

Furthermore, by setting the film thickness of the adhesive agent 113 to 3.0 μm or less, preferably 2.0 μm or less to narrow a path for the ink permeation, the ink permeation into the adhesive agent can be restrained so that the head according to this embodiment can ensure a sufficient product-lifespan.

Because of the bonding under the condition that the adhesive agent film thickness is 3 μm or less, a large amount of a coupling agent is required for heightening the interfacial strength. If the addition amount thereof is reversely small, the ink-repellency of the adhesive agent is unfavorably lowered to cause ink permeation into the adhesive agent 113, so that the bonding strength is lowered.

In order to heighten the bonding strength, it is effective to cause an anchor agent to act onto the bonding interface to fix the adhesive agent 113 and the channel-forming members strongly to each other through ion bonding or covalent bonding. When the members to be bonded are made of metal, the members are strongly fixed against oily ink by hydrogen bonding. Against aqueous ink, however, hydrogen bonding is cleaved by water permeating the bonding interface, so that the bonding strength is remarkably lowered. For this reason, it is desired to allow the adhesive agent and the members to have covalent bonding therebetween.

In order to bind metal to the epoxy adhesive agent through covalent bonding, it is effective to use a silane coupling agent, a titanate-based coupling agent, or an aluminate-based coupling agent. The front surface of the metal members to be bonded may be directly treated with the coupling agent. Treatment with the coupling agent may be conducted after a surface treatment is conducted for heightening the bonding performance of the coupling agent. Even in this case, a strong bonding is gained.

Examples of the coupling agent used as described above are described below.

Silane Coupling Agent:

Examples thereof include 2-(3,4-epoxycyclohexyl)ethyltrimethoxysilane, 3-glycidoxypropyltrimethoxysilane, 3-glycidoxypropylmethyldiethoxysilane, 3-glycidoxypropyltriethoxysilane, N-2-(aminoethyl)-3-aminopropylmethyldimethoxysialne, N-2-(aminoethyl)-3-aminopropylmethyldiethoxysialne, N-2-(aminoethyl)-3-aminopropyltrimethoxysilane, N-2-(aminoethyl)-3-aminopropyltriethoxysilane, 3-aminopropyltrimethoxysilane, 3-aminopropyltriethoxysilane, N-phenyl-3-aminopropyltrimethoxysilane, N,N-bis(3-(trimethoxysilyl)propyl)ethylenediamine, N-(1,3-dimethylbutylidene)-3-(triethoxysilyl)-1-propaneamine, 3-phenylaminopropyltrimethoxysilane, aminoethyl-3-aminopropyltrimethoxysilane, N-(2-(vinylbenzylamino) ethyl)-3-aminopropyltrimethoxysilane, 1,2-ethanediamine, N-{3-(trimethoxysilyl)propyl, an N-{ethenylphenyl}methyl derivative, 3-chloropropyltrimethoxysilane, 3-mercaptopropylmethyldimethoxysilane, 3-mercaptopropyltrimethoxysilane, 3-mercaptopropyltriethoxysilane, bis(triethoxysilylpropyl)tetrasulfide, and 3-isocyanatepropyltriethoxysilane. An organic group of the silane coupling agent is preferably a group having a functional group reactive with the epoxy resin. Examples of such a coupling agent are the above-mentioned coupling agents.

Titanate-Based or Aluminate-Based Coupling Agent:

Examples thereof include tetra-i-propoxytitanium, tetra-n-butoxytitanium, tetrakis(2-ethylhexyloxy)titanium, titanium i-propoxyoctylene glycolate, di-i-propoxy/bis(acetylacetonato)titanium, poly(di-i-propoxy/oxytitanium), poly (di-n-butoxy/oxytitanium), di-n-butoxy/bis (triethanolaminato)titanium, diisopropoxy/bis (triethanolaminate)titanium, isopropyltri(N-amidoethyl/aminoethyl)titanium, and acetoalkoxyaluminum diisopropylate. According to the titanate-based or aluminate-based coupling agent, a polymeric organic coat is formed on the inorganic surface to improve the adhesive agent 113 in wettability, thereby improving the bonding strength. The above-mentioned examples are examples of the titanate-based coupling agent; thus, the coupling agent is not limited thereto.

Any coupling agent is usable. It is preferred, from the viewpoint of compatibility with the adhesive agent 113 or the surface treatment film 112, to use either a coupling agent having an epoxy group or one having an amino group, or both of these coupling agents.

Regarding the epoxy resin that constitutes the epoxy adhesive agent, a cured product in which three-dimensional crosslinkage is formed is obtained by using a polyfunctional compound having an epoxy group. The epoxy resin can be classified into a glycidyl ether-based resin, a glycidyl ester-based resin, a glycidylamine-based resin, and others in accordance with its moiety to which a glycidyl group is bonded. Moreover, in accordance with the kind of a compound as a bonding base, many epoxy resin compounds are obtained. The kind of the epoxy resin used for the adhesive agent is not particularly limited, and thus an optimal resin is selectable in accordance with a material which should be bonded with the adhesive agent, and characteristics of the ink.

In order to restrain the permeation of the ink into the resin to prevent swelling thereof, it is necessary to decrease the hydrophilicity of the epoxy resin and increase the quantity of the three-dimensional linkage. Against the swelling, preferred are polyfunctional epoxy compounds such as glycidylamine-based resins, glycidyl ether compounds of novolak resin, and others. However, it is necessary to consider the wettability thereof onto the members, or the absorptivity. Thus, the epoxy resin may be rendered a mixture of plural compounds. Glycidyl ether of bisphenol A is preferred because of the hydrogen bondability to metal. As the resin is larger in molecular weight, the structure of the resin is richer in elasticity. Such a resin may be appropriately mixed to be used, considering swelling thereof by ink, and cutting of hydrogen bonds in the resin by ink.

The epoxy adhesive agent may be of a solvent-free agent, or may be diluted with a diluting solvent to have an appropriate viscosity. As the diluting solvent, a solvent having no active hydrogen is more preferred than a solvent having active hydrogen, which is reactive with an epoxy group, from the viewpoint of the storability of the adhesive agent. The diluting solvent is selectable at will from the viewpoint of the wettability of the adhesive agent onto the members, the drying rate, the viscosity, and others. The adhesive agent is usable without any problem as far as the adhesive agent forms an adhesive agent layer when dried even if the agent is not completely dissolved but dispersed. For the drying of the adhesive agent containing the solvent, the agent may be allowed to remain at room temperature, or heated as far as no reaction is caused. Drying under reduced pressure may be performed. Even when the used solvent is a high boiling-point solvent, the drying under reduced pressure makes it possible to dry the adhesive agent without causing the epoxy resin to react.

The solvent that can be used is selectable at will in accordance with the epoxy resin, a curing agent, and other additives. The solvent is desirably a solvent in which impurities are controlled in order to advance the curing reaction stably.

The epoxy adhesive agent may contain, besides the above-mentioned epoxy resin, curing agent, solvent and coupling agent, a filler, some other binder resins, a viscosity adjustor, and others. The filler may be inorganic particles such as silica or alumina particles, or resin fine particles such as melamine, or acrylic resin particles. By adding a higher aliphatic acid amide as the viscosity adjustor thereto, the viscosity of the resultant may be adjusted to be appropriate for the coating of the adhesive agent 113. A foaming-restrainer, or an antifoaming agent may be added thereto not to generate coating spots in the coated film by foam.

Usually, the epoxy structure having high crosslinkage density as described above is very high in Young's module. Thus, when the adhesive agent film thickness is made small, the adhesive agent film cannot easily gain a sufficient bonding force. However, a necessary bonding force can be ensured by specifying the film thickness of the adhesive agent in the stacked plates of the channel-forming members into 0.5 μm or more, preferably 1.0 μm or more. The film thickness can be controlled by using a gap agent, such as a silica filler or a resin filler having a controlled particle size.

<Surface Treatment Film>

As the surface treatment of the members that is conducted before the coating of the adhesive agent 113, the formation of an oxidized film containing silicon, such as a $SiO_2$, $SiTaO_x$, $SiZrO_x$ or $SiHfO_x$ film, is very effective against the silane coupling agent. As the method for the treatment, effective is a method of forming a thin film easily, such as a vapor deposition, sputtering, CVD or ALD method.

<Ink>

The ink may be any one of an aqueous ink, in which water is used as a main solvent, an ultraviolet (UV) ink, in which a reactive organic compound is used as a solvent, an oily ink, in which a solvent that does not volatilize at 200° C. or lower is used as a main solvent, and a solvent ink, in which a volatile solvent is used as a main solvent.

<<Aqueous Ink>>

The ink contains at least water and a water-soluble organic solvent, and optionally contains other components, if necessary.

Water-Soluble Organic Solvent:

Examples of the water-soluble organic solvent include polyhydric alcohols, polyhydric alcohol alkyl ethers, polyhydric alcohol aryl ethers, nitrogen-containing heterocyclic compounds, amides, amines, sulfur-containing compounds, propylene carbonate, and ethylene carbonate. A solid wetting agent that is detailed later is also usable as one of the water-soluble organic solvents.

Of these examples, preferred is at least one water-soluble organic solvent selected from triol having 4 or less carbon atoms, polyethylene glycol ethers of triol having 4 or less carbon atoms, polyethylene glycols, and 1,3-propanediol since these compounds are high in equilibrium water content by percentage. The content by percentage of the water-soluble organic solvent is preferably 20% or more by mass, more preferably from 30 to 70% by mass of the whole of the water-soluble organic solvents.

If the content is less than 20% by mass, the ink is decreased in moisturizing power to be easily dried. Thus, the ink is dried in a meniscus portion of the head so that soluble components in the ink are precipitated or dispersible components therein are aggregated. As a result, the ink may fail to be ejected.

Examples of the triol having 4 or less carbon atoms include 1,2,3-butanetriol, 1,2,4-butanetriol, and glycerin.

Examples of the polyethylene glycol ethers of triol having 4 or less carbon atoms include polyoxyethylene glyceryl ether, polyoxyethylene-1,2,3-butanetriol ether, and polyoxyethylene-1,2,4-butanetriol ether.

Examples of the polyethylene glycols include ethylene glycol, diethylene glycol, triethylene glycol, tetraethylene glycol, and polyethylene glycol (PEG) 200.

Of these examples, glycerin is preferred because this compound ensures the stability of ink-ejectability from the head, restrains an increase in the viscosity of wasted ink in an ink-keeping device of the head, and prevents the fixation of the wasted ink in the ink-keeping device satisfactorily since the compound is very high in equilibrium moisture content by percentage in an environment of 23° C. and 80% relative humidity, the value thereof being 49% by mass, to restrain the ink easily from being dried, and further the compound is largely decreased in viscosity when water is incorporated therein.

Besides such a solvent, which is high in equilibrium moisture content by percentage and excellent in moisturizing performance, a different water-soluble solvent is usable if necessary. Examples thereof include polyhydric alcohols, polyhydric alcohol alkyl ethers, polyhydric alcohol aryl ethers, cyclic ethers, amines, amides, sulfur-containing compounds, propylene carbonate, ethylene carbonate, and other organic solvents.

Examples of the polyhydric alcohols include 1,2-propylene glycol, dipropylene glycol, tripropylene glycol, polypropylene glycol, 1,3-butanediol, 3-methyl-1,3-butanediol, 1,5-pentanediol, 2-methyl-2,4-pentanediol, hexylene glycol, 1,6-hexanediol, 1,2,6-hexanetriol, trimethylolethane, trimethylolpropane, 3-methyl-1,3-hexanediol, and propylpropylene diglycol.

Examples of the polyhydric alcohol alkyl ethers include ethylene glycol monoethyl ether, ethylene glycol monobutyl ether, diethylene glycol monomethyl ether, diethylene glycol monoethyl ether, diethylene glycol monobutyl ether, ethylene glycol mono-2-ethylhexyl ether, propylene glycol monoethyl ether, and triethylene glycol dimethyl ether.

Examples of the polyhydric alcohol aryl ethers include ethylene glycol monophenyl ether, and ethylene glycol monobenzyl ether.

Examples of the cyclic ethers include epoxy compounds, oxetanes, tetrahydrofurans, tetrahydropyrans, and crown ethers.

Of these examples, oxetanes and tetrahydrofurans are preferred. Oxetanes are more preferred from the viewpoint of the water-solubility thereof.

Examples of the sulfur-containing compounds include dimethylsulfoxide, sulfolane, and thiodiglycol.

Examples of the amines include monoethanolamine, diethanolamine, triethanolamine, N,N-dimethylmonoethanolamine, N-methyldiethanolamine, N-methylethanolamine. N-phenylethanolamine, and 3-aminopropyldiethylamine.

Examples of the amide compounds include 2-pyrrolidone, N-methyl-2-pyrrolidone, 1,3-dimethyl-2-imidazolidinone, ϵ-caprolactam, γ-butyrolactone, β-methoxy-N,N-dimethylpropionamide, and β-butoxy-N,N-dimethylpropionamide.

Water-soluble amide compounds are polar solvents in which many organic compounds and inorganic salts are soluble, and are miscible with solvents within a broad range from water to organic solvents. Thus, the amide compounds produce an effect of improving wettability or solubility in a medium, stability of miscibility with other components, and others.

Examples of the amide compounds include amide compounds that are of a noncyclic amide compound species, and are each represented by the following general formula:

[Chem. 1]

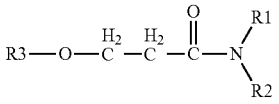

Each of R1 and R2 is a hydrocarbon chain having one to four carbon atoms. R3 is a methyl group and n is a butyl group.

The amide compounds represented by the general formula are varied in hydrophilicity and miscibility with water or an organic solvent in accordance with the length of their alkyl group.

An amide compound in which the alkyl group is a methyl group has a high boiling point of 216° C., a high equilibrium water content by percentage of 39.2% by weight in an environment of 23° C. and 80% relative humidity, and a very high liquid viscosity of 1.48 mPa·s at 25° C. Furthermore, the compound is very easily soluble in water-soluble organic solvents and water, so that the compound can make the ink low in viscosity. Thus, the compound is very preferred as the water-soluble organic solvent used in the ink. The ink containing this amide compound is an ink good in storage stability and ejection stability, and friendly to a device for keeping and restoring the ink.

An amide compound in which the alkyl group is a butyl group is unrestrictedly soluble in water, is soluble in liquid paraffin and n-hexane, and has a high boiling point of 252° C. Thus, the compound can be added as an agent for improving permeation into the ink, or a solubilizer.

These compounds are each high in solubility, and also high in solubility into conventional adhesive agents. Thus, the addition proportion thereof into ink is not easily increased. Consequently, in a head using an adhesive agent, such as a stacked type head, the addition proportion of such an amide compound into an ink to be used is 10% or less by weight. The addition thereof in a large proportion causes the problem that the compound attacks bonding interfaces between its stacked members so that the head does not gain a sufficient strength.

In the case of the head according to this embodiment, in which the surface treatment film is used, the content by percentage of the amide compound in the ink can be adjusted to 20% or more by weight.

The addition proportion of such an amide compound is preferably 20% or more by weight from the viewpoint of solid evenness of an image printed with the ink. If the proportion is more than 60% by weight, the ink is poor in dryability on paper, and further ink-printed characters on plain paper may be lowered in quality.

The solid wetting agent is preferably a saccharide or some other.

Examples of the saccharide include monosaccharides, disaccharides, oligosaccharides (trisaccharides, and tetrasaccharides), and polysaccharides. Specific examples thereof include glucose, mannose, fructose, ribose, xylose, arabinose, galactose, maltose, cellobiose, lactose, sucrose, trehalose, and maltotriose.

The polysaccharides mean sugars in a wide sense, and the term is used with a meaning including α-cyclodextrin, cellulose, and substances present broadly in the nature.

Examples of derivatives of these saccharides include reduced saccharides of the above-mentioned saccharides (for example, sugar alcohols (general formula: $HOCH_2(CHOH)CH_2OH$ wherein n represents an integer of 2 to 5), and oxidized saccharides (for example, aldonic acid, and uronic acid), amino acids, and thio acids.

Of these examples, sugar alcohols are preferred, specific example thereof including maltitol and sorbitol.

The total content by percentage of the solvent(s) in the ink is preferably from 10 to 50% by mass, more preferably from 15 to 40% by mass. If the total content is less than 15% by weight, the ink may be lowered in ejection stability. On the other hand, if the total content is more than 50% by mass, the ink is poor in dryability on paper so that it takes a long period to dry and fix the ink.

Coloring Agent:

The ink may contain a coloring agent for coloring a record-receiving medium. The color tone of the ink can be adjusted by adding a coloring component thereto. A colorant to be used may be a pigment or a dye. Preferably, a pigment is used from the viewpoint of color-fading based by light. A dye may also be used.

The pigment may be an organic pigment or inorganic pigment. For the purpose of color tone adjustment, the ink may simultaneously contain dye. The dye is usable as far as the dye does not deteriorate the ink in weather resistance. From the viewpoint of the weather resistance, mainly, a pigment is preferably used; the ink may simultaneously contain dye for the color tone adjustment as far as the dye does not deteriorate the weather resistance.

Examples of the inorganic pigment may include titanium oxide, iron oxide, calcium carbonate, barium sulfate, aluminum hydroxide, barium yellow, cadmium red, chrome yellow, and carbon black produced by a known method such as the contact method, the furnace method, or the thermal method.

Examples of the organic pigment may include azo pigments (such as azo lakes, and insoluble azo pigments, condensed azo pigments, and chelate azo pigments), polycyclic pigments (such as phthalocyanine pigments, perylene pigments, perynone pigments, anthraquinone pigments, quinacridone pigments, dioxazine pigments, indigo pigments, thioindigo pigments, isoindolinone pigments, and quinofranone pigments), dye chelates (such as basic dye type chelates, and acidic dye type chelates), nitro pigments, nitroso pigments, and aniline black. Of these pigments, pigments particularly good in affinity with water are preferably used.

A preferred form of such a pigment is such a form that the pigment is surface-modified to bond at least one hydrophilic group directly or through a different atomic group to the surface of the pigment. For this purpose, a method is used in which a specified functional group (such as a sulfone or carboxyl group) is chemically bonded to the surface of the pigment, or the pigment is subjected to wet oxidizing treatment with hypohalous acid and/or a salt thereof. A more preferred form thereof is such a form that a carboxyl group is bonded to the surface of the pigment, and the pigment is dispersed in water. Also in the case, the pigment is surface-modified and the carboxyl group is bonded thereto so as to be improved in dispersion stability. Additionally, this case gives a high print quality and improves the water resistance of a recording medium printed with the ink.

Since the ink in this form is excellent in re-dispersibility after dried, the nozzles of the ink-jet head are not clogged and satisfactory printing is easily attained after a simple cleaning operation even when printing is stopped for a long period so that water in the ink in the vicinity of the nozzles is evaporated. Such a pigment, which is a pigment of a self-dispersing type, produces a particularly large synergetic effect when the pigment is combined with a surfactant and a permeating agent that is detailed later. As a result, the ink can give a high-quality image higher in reliability.

Besides the pigment in the above-mentioned form, a polymer emulsion is usable in which pigment is incorporated into polymer fine particles. The pigment-incorporated polymer emulsion is a material in which pigment is enclosed into polymer fine particles, or a material in which pigment is adsorbed onto the surface of polymer fine particles. In this case, it is unnecessary that the whole of the pigment is enclosed thereinto or adsorbed thereonto. The pigment may be dispersed in an emulsion. Examples of the polymer that forms the polymer emulsion include vinyl polymers, polyester polymers, and polyurethane polymers. Particularly preferred are vinyl polymers, and polyester polymers.

A water-soluble dye may be used together with the pigment. The dye is in particular preferably an acidic dye or direct dye.

The addition proportion of the coloring agent in the ink is preferably from about 1 to 15% by weight, more preferably from about 3 to 12% by weight.

Surfactant:

The surfactant may be an anionic surfactant, nonionic surfactant or amphoteric surfactant. In accordance with the kind of the coloring agent, and a combination with the wetting agent and water-soluble organic solvent, a surfactant that does not damage the dispersion stability is selected.

Examples of the anionic surfactant include polyoxyethylene alkyl ether acetates, dodecylbenzene sulfonates, succinic acid ester sulfonates, lauric acid salts, polyoxyethylene alkyl ether sulfate salts.

Examples of the nonionic surfactant include polyoxyethylene alkyl ethers, polyoxyethylene polyoxypropylene alkyl ethers, polyoxyethylene alkyl esters, polyoxyethylene polyoxypropylene alkyl esters, polyoxyethylene sorbitan fatty acid esters, polyoxyethylene alkyl phenyl ethers, polyoxyethylene alkylamines, and polyoxyethylene alkylamides.

Examples of the amphoteric surfactant include laurylaminopropionic acid salts, lautyldimethylbetaine, stearyldimethylbetaine, and lauryldihydroxyethylbetaine. Specifically, the following surfactants are preferably usable although the surfactant is not limited thereto: lauryldimethylamine oxide, myristyldimethylamine oxide, stearyidimethylamine oxide, dihydroxyethyllaurylamine oxide, polyoxyethylene coconut oil alkyldimethylamine oxide, dimethylalkyl(palm) betaine, and dimethyllaurylbetaine.

An acetylene glycol-based surfactant is usable, examples thereof including 2,4,7,9-tetramethyl-5-decyne-4,7-diol, 3,6-dimethyl-4-octyne-3,6-diol, and 3,5-dimethyl-1-hexyn-3-ol, and other acetylene glycol-based surfactants (such as SURFYNOLs 104, 82, 465, 485 and TG, manufactured by Air Products and Chemicals Inc.). In particular, SURFINOLs 465, 104, and TG allows the ink to exhibit a good print quality.

A fluorine-containing surfactant is usable, examples thereof including perfluoroalkylsulfonates, perfluoroalkylcarboxylates, perfluoroalkylphosphates, perfluoroalkylethylene oxide adducts, perfluoroalkylbetaine, perfluoroalkylamine oxide compounds, polyoxyalkylene ether polymers each having, as a side chain thereof, a perfluoroalkyl ether group and sulfuric ester salts thereof, and fluorine-containing aliphatic polymer esters.

Commercially available examples of these fluorine-containing surfactants include SURFLONs S-111, S-112, S-113, S121, S131, S132, S-141, and S-145 (manufactured by Asahi Glass Co., Ltd.): FLUORADs FC-93, FC-95, FC-98, FC-129, FC-135, FC-170C, FC-430, FC-431, and FC-4430 (manufactured by Sumitomo 3M Ltd.); FTs-110, 250, 251, and 400S (manufactured by Neos Co., Ltd.); Zonyls FS-62, FSA, FSE, FSJ, FSP, TBS, UR, FSO, FSO-100, FSN N, FSN-100, FS-300, and FSK (manufactured by DuPont); and POLYFOXs PF-136A, PF-156A, and PF-151N (Omnova Solutions Inc.).

The surfactant is not limited to these surfactants. These may be used alone or in the form of a mixture of two or more thereof. Even when one of the surfactants is not easily dissolved in the recording ink, the surfactant may be stably present by mixing the surfactant with another surfactant to be solubilized.

The total content by percentage of the surfactant(s) is desirably from 0.01 to 5% by weight to allow the surfactant(s) to exhibit a permeating effect. If the total content by percentage of the surfactant(s) is less than 0.01% by weight, the addition thereof produces no advantageous effect. If the total content is more than 5.0% by weight, the permeating performance into a recording medium is higher than required, so as to cause problems of a decline in the image density, and the permeation of the ink in the rear surface. The total content is more preferably from 0.5 to 2% by weight to allow the ink to cope with plain paper pieces having various physical properties.

Permeating Agent:

The permeating agent desirably contains at least one polyol having a solubility of 0.2% by weight or more and less than 5.0% by weight in water of 20° C.

Specific examples of an aliphatic diol out of such polyols include 2-ethyl-2-methyl-1,3-propanediol, 3,3-dimethyl-1,2-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, and 2-ethyl-1,3-hexanediol.

Of these examples, 2-ethyl-1,3-haxanediol and 2,2,4-trimethyl-1,3-pentanediol are most desirable.

Examples of a different permeating agent that is usable together therewith include alkyl and aryl ethers of polyhydric alcohol such as diethylene glycol monophenyl ether, ethylene glycol monophenyl ether, ethylene glycol monoallyl ether, diethylene glycol monophenyl ether, diethylene glycol monobutyl ether, propylene glycol monobutyl ether, and tetraethylene glycol chlorophenyl ether; and lower alcohols such as ethanol. However, the permeating agent is not limited to these examples as far as the agent is soluble in the ink so that the ink is adjustable to a desired physical property.

Even when the permeating agent is an agent lower in solubility in water, this agent is usable as a permeating agent as far as the agent is solubilized with the above-mentioned amide compounds not to be precipitated. In conventional inks, the proportion of such an amide compound added thereto is small, so that the solubilizing effect is small. However, the amide compound may be added in a large proportion to the ink described hereinbefore; thus, a hardly soluble organic compound that is not conventionally usable can also be added to the ink. Thus, the ink can be allowed to permeate coated paper for printing, or any other paper into which a conventional ink is not easily allowed to permeate.

The addition proportion of the permeating agent is desirably from 0.1 to 4.0%. If the addition proportion is less than 0.1%, the ink does not gain rapid dryability to give a blurred image. Reversely, if the addition proportion is more than 4.0%, the dispersion stability of the coloring agent is damaged so that the nozzles are easily clogged, or the permeating performance of the ink into a recording medium becomes higher than required, so as to cause problems of a decline in the image density, and the permeation of the ink in the rear surface.

Since the permeating agent is an organic substance strong in hydrophobicity, the agent is also high in affinity with the adhesive agent of the adhesive agent layer of the head to permeate the layer easily. Thus, in a head using an adhesive agent, such as a stacked type head, the addition of a large proportion of the permeating agent into an ink causes the problem that the permeating agent attacks bonding interfaces between its stacked members through the adhesive agent, so that the head does not gain sufficient strength.

In the head according to this embodiment, in which the surface treatment film is used, the addition of a large proportion of the permeating agent is allowable for improving the bonding interfaces in endurance.

Water-Dispersible Resin:

A water-dispersible resin is usable in the ink, examples thereof including condensed type synthetic resins (such as polyester resins, polyurethane resins, polyepoxy resins, polyamide resins, polyether resins, and silicone resins), addition type synthetic resins (such as polyolefin resins, polystyrene-based resins, polyvinyl alcohol-based resins, polyvinyl ester-based resins, polyacrylic resins, and unsaturated carboxylic acid resins), natural polymers (such as celluloses, rosins, and natural rubbers). The resin is usable in the form of a homopolymer, copolymer, or composite type resin, and may be any one of a single-phase structure type, a core-shell type, a power field type, and an emulsion type. The water-dispersible resin may be a resin which itself has a hydrophilic group to have self-dispersibility, or a resin which itself has no dispersibility but has dispersibility given by a surfactant or a resin having a hydrophilic group. Optimal is, in particular, an ionomer of a polyester resin or polyurethane resins, or an emulsion of resin particles that is obtained by emulsion-polymerizing or suspension-polymerizing an unsaturated monomer. In the case of emulsion-polymerizing the unsaturated monomer, reaction is conducted in water to which the unsaturated monomer, a polymerization initiator, a surfactant, a chain transfer agent, a chelating agent, a pH adjustor and others are added, thereby yielding a resin emulsion. Thus, a water-dispersible resin can be easily obtained, and the structure of the resin can be easily varied. Consequently, a target property can be easily created. Usable examples of the unsaturated monomer include unsaturated carboxylic acids, (meth)acrylate monomers, (meth)acrylic acid amide monomers, aromatic vinyl monomers, vinylcyan compound monomers, vinyl monomers, allyl compound monomers, olefin monomers, diene monomers, and oligomers each having an unsaturated carbon atom. These may be used alone or in combination. When two or more of these monomers are combined with each other, the nature of the resultant resin can be flexibly modified. The property of the resin can be also modified by using an oligomer type polymerization initiator to conduct polymerization reaction or graft reaction.

The nature of the water-dispersible resin can be flexibly modified by using the unsaturated monomers alone or in combination to be made into a resin by aid of a polymerization initiator. In the water-dispersible resin, molecular chains thereof are cleaved by dispersion breakdown, hydrolysis or some other under a strong alkaline or acidic condition. Thus, the pH is desirably from 4 to 12. The pH is in particular preferably from 6 to 11, more preferably from 7 to 9 from the viewpoint of the miscibility of the resin with the water-dispersible coloring agent.

The particle size of the water-dispersible resin is related to the viscosity of the dispersion liquid. As the particle size is smaller, the viscosity of the liquid is larger at the same solid content when the composition of the liquid is not varied. The average particle size of the water-dispersible resin is desirably 50 nm or more in order that when the resin is made into ink, the ink may not have excessively high viscosity. If the particle size is several tens μ, the particle size is larger than the nozzle diameter of the ink-jet head so that the ink cannot be used. It is known that even if the particle size is smaller than the nozzle diameter, the ink is deteriorated in ejectability when some of the particles present in the ink are large particles. The average particle size is preferably 500 nm or less, in particular preferably 150 nm or less in order that the particles may not hinder the ink-ejectability.

It is desired that the water-dispersible resin has a function of fixing a water-dispersible coloring agent onto a paper piece surface, and is made into a coat film at room temperature to improve the coloring agent in fixability. For this purpose, the minimum film-forming temperature (MFT) is preferably room temperature or lower. Specifically, the temperature is desirably 20° C. or lower. However, if the glass transition temperature of the resin is −40° C. or lower, the viscosity of the resin coat film becomes strong so that a tacky printed matter is produced. Thus, the water-dispersible resin desirably has a glass transition temperature of −30° C. or higher.

Examples of other additives to be added into the ink include an antiseptic and antifungal agent, a pH adjustor, a chelating agent, and an anti-rust agent. However, the additives are not limited thereto.

The pH adjustor may be any substance as far as the substance can allow the pH of the recording liquid prepared to be adjusted to a desired value without producing any adverse effect onto the liquid.

"Other Additives"

The other additives are not particularly limited. Thus, as the need arises, appropriate additives are selectable. Examples thereof include a pH adjustor, an antiseptic and antifungal agent, a chelating agent, an anti-rust agent, an antioxidant, an ultraviolet absorbent, an oxygen absorbent, a light stabilizer, and an antifoaming agent.

pH Adjustor:

The pH adjustor is not particularly limited as far as the adjustor can allow the pH of the recording ink prepared to be adjusted to the range of 7 to 11 without producing any adverse effect on the ink for recording. Thus, an appropriate adjustor is selectable in accordance with the purpose. Examples thereof include alcoholamines, hydroxides of alkali metal element, hydroxides of ammonium, phosphonium hydroxides, and carbonates of alkali metal.

If the pH is less than 7 or more than 11, the ink-jet head or an ink-supplying unit therefor is largely eluted out to cause the inconveniences that the ink may denature or leak, or fail to be ejected.

Examples of the alcoholamines include diethanolamine, triethanolamine, and 2-amino-2-ethyl-1,3-propanediol.

Examples of the hydroxides of alkali metal element include lithium hydroxide, sodium hydroxide, and potassium hydroxide.

Examples of the hydroxides of ammonium include ammonium hydroxide, tertiary ammonium hydroxide, and tertiary phosphonium hydroxide.

Examples of the carbonates of alkali metal include lithium carbonate, sodium carbonate, and potassium carbonate.

Antiseptic and Antifungal Agent:

Examples of the antiseptic and antifungal agent include sodium dehydroacetate, sodium sorbate, sodium 2-pyridinethiol-1-oxide, sodium benzoate, and sodium pentachlorophenol.

Chelating Agent:

Examples of the chelating agent include sodium ethylenediaminetetraacetate, sodium nitrilotriacetate, sodium hydroxyethylethylenediaminetriacetate, sodium diethylenetriaminepentaacetate, and sodium uramildiacetate.

Anti-Rust Agent:

Examples of the anti-rust agent include acidic sulfites, sodium thiosulfate, ammonium thiodiglycolate, diisopropylammonium nitrite, pentaerythritol tetranitrate, and dicyclohexylammonium nitrite.

Antioxidant:

Examples of the antioxidant include phenol-based antioxidants (including hindered phenol-based antioxidants), amine-based antioxidants, and sulfur-containing and phosphorous-containing antioxidants.

Ultraviolet Absorbent:

Examples of the ultraviolet absorbent include benzophenone-based, benzotriazole-based, salicylate-based, cyanoacrylate-based, and nickel complex salt-based ultraviolet absorbents.

Antifoaming Agent:

Examples of the antifoaming agent include silicone-, polyether-, and aliphatic acid ester-antifoaming agents. When an ink containing a large proportion of inorganic fine particles is used with an ordinary antifoaming agent together from the viewpoint of heightening a foam-breaking effect, it is necessary that the ink for recording using the antifoaming agent contains coarse particles having a particle size of 0.5 μm or more in a density of $3.0\times10^7$/5-μL or less, and further the ratio of the number of particles having a particle size of 1 μm or more and less than 5 μm to the number of the coarse particles is 1% or less. It is therefore advisable to remove the inorganic fine particles appropriately as the need arises, or the like.

Ink:

The ink is produced by dispersing or dissolving, into an aqueous medium, the coloring agent, water-soluble organic solvent (wetting agent), surfactant, permeating agent, water-dispersible resin and water, as well as optional other components, and optionally stirring these components to be mixed with each other.

The dispersing can be attained, using, for example, a sand mill, a homogenizer, a ball mill, a paint shaker, or an ultrasonic disperser. The stirring and mixing can be attained by, for example, a stirrer having ordinary stirring vanes, a magnetic stirrer, or a high-speed disperser.

The physical properties of the ink are not particularly limited. Thus, appropriate properties are selectable in accordance with the purpose. Preferably, for example, the viscosity and the surface tension are adjusted to respective ranges described below.

The viscosity of the ink is preferably from 3 to 20 mPa·s at 25° C.

By adjusting the ink viscosity to 3 mPa·s or more, the ink gains an effect of improving the print density and character quality. By suppressing the ink viscosity to 20 mPa·s or less, the ink can ensure ejectability. The viscosity is measurable at 25° C., using, for example, a viscometer (RL-550, manufactured by Toki Sangyo Co., Ltd.).

The surface tension of the ink is preferably 35 mN/m or less, more preferably 32 mN/m or less at 25° C. If the surface tension is more than 35 mN/m, the ink is not easily leveled on a recoding medium so that a long period may be required for drying the ink.

The kinds of a non-aqueous ink are as follows:

<<UV Ink>>

The photocurable ink occupies a composition of the ink in a proportion of 10 to 70% by weight. A compound usable therefor is varied in accordance with photocuring reaction to be used. The compound is classified into a radical polymerizable type using an optically radical-generating initiator, and a cation polymerizable type using an optically acid-generating initiator.

The radical polymerizable type and the cation polymerizable type are usable in the form of a mixture. A use form thereof may be designed at will in accordance with the curing property, the adhesion strength, and an image-forming process.

(Radical Polymerizable Type)

A photocurable compound of the radical polymerizable type may be a compound having an unsaturated hydrocarbon chain as a reactive functional group, and is preferably a compound having a vinyl, isopropenyl, allyl, metallyl, acryloyl, methacryloyl, propioloyl, or maleoyl group.

(Monofunctional Compound)

Examples of the photocurable compound having a single functional group include 2-ethylhexyl(meth)acrylate (EHA), 2-hydroxyethyl(meth)acrylate (HEA), 2-hydroxypropyl (meth)acrylate (HPA), caprolactone-modified tetrahydrofurfuryl(meth)acrylate, isobornyl(meth)acrylate, 3-methoxybutyl(meth)acrylate, tetrahydrofurfuryl(meth)acrylate, lauryl (meth)acrylate, 2-phenoxyethyl(meth)acrylate, isodecyl (meth)acrylate, isooctyl(meth)acrylate, tridecyl(meth) acrylate, caprolactone(meth)acrylate, ethoxylated nonylphenol(meth)acrylate, and oxetane(meth)acrylate.

(Bifunctional Compound)

Examples of the photocurable compound having two functional groups include tripropylene glycol di(meth)acrylate, triethylene glycol di(meth)acrylate, tetraethylene glycol di(meth)acrylate, polypropylene glycol di(meth)acrylate, neopentyl glycol hydroxypivalic acid ester di(meth)acrylate (MANDA), hydroxypivalic acid neopentyl glycol ester di(meth)acrylate (HPNDA), 1,3-butanediol di(meth)acrylate (BGDA), 1,4-butanediol di(meth)acrylate (BUDA), 1,6-hexanediol di(meth)acrylate (HDDA), 1,9-nonanediol di(meth)acrylate, diethylene glycol di(meth)acrylate (DEGDA), neopentyl glycol di(meth)acrylate (NPGDA), tripropylene glycol di(meth)acrylate (TPGDA), caprolactone-modified hydroxypivalic acid neopentyl glycol ester di(meth)acrylate, propoxylated neopentyl glycol di(meth) acrylate, ethoxy-modified bisphenol A di(meth)acrylate, polyethylene glycol 200 di(meth)acrylate, and polyethylene glycol 400 di(meth)acrylate.

(Polyfunctional Compound)

Examples of the photocurable compound having polyfunctional groups include trimethylolpropane tri(meth)acrylate (TMPTA), pentaerythritol tri(meth)acrylate (PETA), dipentaerythritol hexa(meth)acrylate (DPHA), triallylisocyanate, ϵ-caprolactone-modified dipentaerythritol(meth) acrylate, tris(2-hydroxyethyl)isocyanurate tri(meth)acrylate, ethoxylated trimethylolpropane tri(meth)acrylate, propoxylated trimethylolpropane tri(meth)acrylate, propoxylated glycerin tri(meth)acrylate, pentaerythritol tetra(meth)acrylate, ditrimethylolpropane tetra(meth)acrylate, dipentaerythritol hydroxypenta(meth)acrylate, ethoxylated pentaerythritol tetra(meth)acrylate, and penta(meth)acrylate esters.

(Oligomers)

Examples of radical polymerizable type oligomers include polyester-based resins, acrylic resins, epoxy-based resins, urethane-based resins, alkyd resins, ether-based resins, and acrylates and methacrylates of polyhydric alcohol.

(Curable Polymers)

Examples of radical polymerizable type curable polymers include water-soluble resins each having a polymerizable functional group, and emulsion type photocurable resins.

At least one selected from the above-mentioned radical polymerizable type photocurable compounds may be used, or two or more selected therefrom may be used in the form of a mixture.

The optical radical polymerization initiator is classified into a molecule-cleaving type photopolymerization initiator and a hydrogen-withdrawing type photopolymerization initiator.

Examples of the molecule-cleaving type photopolymerization initiator include 2,2-dimethoxy-1,2-diphenylethan-1-one, 1-hydroxycyclohexyl phenyl ketone, 2-hydroxy-2-methyl-1-phenylpropan-1-one, 1-[4-(2-hydroxyethoxy)-phenyl]-2-hydroxy-2-methyl-1-propan-1-one, 2-hydroxy-1-{4-[4-(2-hydroxy-2-methylpropionyl)benzyl]phenyl}-2-methyl-1-propan-1-one, oligo[2-hydroxy-2-methyl-1-[4-(1-methylvinyl)phenyl]propanone, phenylglyoxylic acid methyl ester, 2-methyl-1-[4-(methylthio)phenyl]-2-morpholinopropan-1-one, 2-benzyl-2-dimethylamino-1-(4-morpholinophenyl)butanone-1, 2-dimethylamino-2-(4-methylbezyl)-1-(4-morpholin-4-yl-phenyl)butan-1-one, bis(2,4,6-trimethylbenzoyl)phenylphosphine oxide, bis(2,6-dimethoxybenzoyl)-2,4,4-trimethyl-pentylphosphine oxide, 2,4,6-trimethylbenzoylphosphine oxide, 1,2-octanedione-[4-(phenylthio)-2-(o-benzoyloxime)], ethanone-1-[9-ethyl-6-(2-methylbenzoyl)-9H-carbazol-3-yl]-1-(O-acetyloxime), and [4-(methylphenylthio)phenyl]phenylmethanone.

Examples of the hydrogen-withdrawing type photopolymerization initiator include benzophenone-based compounds such as benzophenone, methylbenzophenone, methyl-2-benzoyl benzoate, 4-benzoyl-4'-methyldiphenylsulfide, and phenylbenzophenone; and thioxanthone-based compounds such as 2,4-diethylthioxanthone, 2-chlorothioxanthone, isopropylthioxanthone, and 1-chloro-4-propylthioxanthone.

An amine compound is together usable as a polymerization promoter.

Examples thereof include ethyl p-dimethylaminobenzoate, 2-ethylhexyl p-dimethylaminobenzoate, methyl p-dimethylaminobenzoate, 2-dimethylaminoethyl benzoate, and butoxyethyl p-dimethylaminobenzoate.

(Cation Polymerizable Type)

Main examples of a photocurable compound of the cation polymerizable type include vinyl aromatic compounds, vinyl ethers, N-vinylamides, compounds each having an epoxy group, and compounds each having an oxetanyl group.

(Vinyl Aromatic Compounds)

Examples thereof include styrene, p-methylstyrene, p-methoxystyrene, β-methylstyrene, p-methyl-β-methylstyrene, α-methylstyrene, p-methoxy-β-methylstyrene, 1-vinylnaphthalene, α-methyl-1-vinylnaphthalene, β-methyl-1-vinylnaphthalene, 4-methyl-1-vinylnaphthalene, and 4-methoxy-1-vinylnaphthalene.

(Vinyl Ethers)

Examples thereof include isobutyl vinyl ether, ethyl vinyl ether, phenyl vinyl ether, p-methylphenyl vinyl ether, p-methoxyphenyl vinyl ether, α-methylphenyl vinyl ether, β-methylisobutyl vinyl ether, β-chloroisobutyl vinyl ether, ethylene glycol divinyl ether, 2-chloroethyl vinyl ether, 2-hydroxyethyl vinyl ether, triethylene glycol divinyl ether, 1,4-cyclohexanedimethanol divinyl ether, hydroxybutyl vinyl ether, and propenyl ether of propylene glycol.

(N-Vinylamides)

Examples thereof include N-vinylcarbazole, N-vinylpyrrolidone, N-vinylindole, N-vinylpyrrole, N-vinylphenothiazine, N-vinylacetoanilide, N-vinylethylacetoamide, N-vinylsuccinimide, N-vinylphthalimide, N-vinylcaprolactam, and N-vinylimidazole.

(Compounds Each Having an Epoxy Group)

Examples thereof include hydrogenated bisphenol A diglycidyl ether, 3,4-epoxycyclohexylmethyl-3,4-epoxycyclohexane carboxylate, 3,4-epoxy-1-methylcyclohexyl-3,4-epoxy-1-methylhexane carboxylate, 6-methyl-3,4-epoxycyclohexylmethyl-6-methyl-3,4-epoxycyclohexane carboxylate, 3,4-epoxy-3-methylcyclohexylmethyl-3,4-epoxy-3-methylcyclohexane carboxylate, 3,4-epoxy-5-methylcyclohexylmethyl-3,4-epoxy-5-methylcyclohexane carboxylate, 2-(3,4-epoxycyclohexyl-5,5-spiro-3,4-epoxy) cyclohexane-metadioxane, bis(3,4-epoxycyclohexylmethyl) adipate, 3,4-epoxy-6-methylcyclohexyl carboxylate, methylenebis(3,4-epoxycyclohexane), dicyclopentadiene diepoxide, ethylenebis(3,4-epoxycyclohexane carboxylate), dioctyl epoxyhexahydrophthalate, di-2-ethylhexyl epoxyhexahydrophthalate, 1-epoxyethyl-3,4-epoxycyclohexane, 1,2-epoxy-4-epoxyethylcyclohexane, 3,4-epoxycyclohexylmethyl acrylate, 3,4-epoxycyclohexylmethyl methacrylate, 1,4-butanediol diglycidyl ether, 1,6-hexanediol diglycidyl ether, glycidyl ethers of polyhydric alcohol such as triglycidyl ether of glycerin, triglycidyl ether of trimethylolpropane, tetraglycidyl ether of sorbitol, hexaglycidyl ether of dipentaerythritol, diglycidyl ether of polyethylene glycol or diglycidyl ether of polypropylene glycol, polyglycidyl ethers of polyether polyol that are each obtained by adding one or more alkylene oxides to an aliphatic polyhydric alcohol such as propylene glycol, trimethylolpropane or glycerin, and diglycidyl ester of an aliphatic long-chain dibasic acid. Other examples thereof include monoglycidyl ethers of polyether alcohol that are each obtained by adding an alkylene oxide to a monoglycidyl ether of an aliphatic higher alcohol, phenol, cresol or butylphenol, or two or more thereof; glycidyl esters of higher aliphatic acid; epoxidized soybean oil; octyl epoxystearate; butyl epoxystearate; and epoxidized polybutadiene.

(Compounds Each Having an Oxetanyl Group)

Examples thereof include 3-ethyl-3-hydroxymethyloxetane, 3-(meth)allyloxymethyl-3-ethyloxetane, (3-ethyl-3-oxetanylmethoxy)methylbenzene, 4-fluoro-[1-(3-ethyl-3-oxetanylmethoxy)methyl]benzene, 4-methoxy-[1-(3-ethyl-3-oxetanylmethoxy)methylbenzene, [1-(3-ethyl-3-oxetanylmethoxy)ethyl]phenyl ether, isobutoxymethyl (3-ethyl-3-oxetanylmethyl)ether, isobornyloxyethyl (3-ethyl-3-oxetanylmethyl)ether, isobornyl (3-ethyl-3-oxetanylmethyl)ether, 2-ethylhexyl (3-ethyl-3-oxetanylmethyl)ether, ethyldiethylene glycol (3-ethyl-3-oxetanylmethyl)ether, dicyclopentadiene (3-ethyl-3-oxetanylmethyl) ether, dicyclopentenyloxyethyl (3-ethyl-3-oxetanylmethyl) ether, dicyclopentenyl (3-ethyl-3-oxetanylmethyl)ether, tetrahydrofurfuryl (3-ethyl-3-oxetanylmethyl)ether, tetrabromophenyl (3-ethyl-3-oxetanylmethyl)ether, 2-tetrabromophenoxyethyl (3-ethyl-3-oxetanylmethyl)ether, tribromophenyl (3-ethyl-3-oxetanylmethyl)ether, 2-tribromophenoxyethyl (3-ethyl-3-oxetanylmethyl)ether, 2-hydroxyethyl (3-ethyl-3-oxetanylmethyl)ether, 2-hydroxypropyl (3-ethyl-3-oxetanylmethyl)ether, butoxyethyl (3-ethyl-3-oxetanylmethyl)ether, pentachlorophenyl (3-ethyl-3-oxetanylmethyl)ether, pentabromophenyl (3-ethyl-3-oxetanylmethyl)ether, bornyl (3-ethyl-3-oxetanylmethyl)ether, 3,7-bis(3-oxetanyl)-5-oxa-nonane, 3,3'-(1,3-(2-methylenyl)propanediylbis(oxymethylene))bis-(3-ethyloxetane), 1,4-bis[(3-ethyl-3-oxetanylmethoxy)methyl] benzene, 1,2-bis[(3-ethyl-3-oxetanylmethoxy)methyl] ethane, 1,3-bis[(3-ethyl-3-oxetanylmethoxy)methyl] propane, ethylene glycol bis(3-ethyl-3-oxetanylmethyl) ether, dicyclopentenyl bis(3-ethyl-3-oxetanylmethyl)ether, triethylene glycol bis(3-ethyl-3-oxetanylmethyl)ether, tetraethylene glycol bis(3-ethyl-3-oxetanylmethyl)ether, tricyclodecanediyldimethylene (3-ethyl-3-oxetanylmethyl)ether, trimethylolpropane tris(3-ethyl-3-oxetanylmethyl)ether, 1,4-bis(3-ethyl-3-oxetanylmethoxy)butane, 1,6-bis(3-ethyl-3-oxetanylmethoxy)hexane, pentaerythritol tris(3-ethyl-3-oxetanylmethyl)ether, pentaerythritol tetrakis(3-ethyl-3-oxetanylmethyl)ether, polyethylene glycol bis(3-ethyl-3-oxetanylmethyl)ether, dipentaerythritol hexakis(3-ethyl-3-oxetanylmethyl)ether, dipentaerythritol pentakis(3-ethyl-3-oxetanylmethyl)ether, dipentaerythritol tetrakis(3-ethyl-3-oxetanylmethyl)ether, caprolactone-modified dipentaerythritol hexakis(3-ethyl-3-oxetanylmethyl)ether, caprolactone-modified dipentaerythritol pentakis(3-ethyl-3-oxetanylmethyl)ether, ditrimethylolpropanetetrakis(3-ethyl-3-oxetanylmethyl)ether, EO-modified bisphenol A bis(3-ethyl-3-oxetanylmethyl)ether, PO-modified bisphenol A bis (3-ethyl-3-oxetanylmethyl)ether, EO-modified hydrogenated bisphenol A bis(3-ethyl-3-oxetanylmethyl) ether, PO-modified hydrogenated bisphenol A bis(3-ethyl-3-oxetanylmethyl)ether, EO-modified bisphenol F (3-ethyl-3-oxetanylmethyl)ether, oxetane(meth)acrylate, 3-ethyl-3-hydroxymethyloxetane, 1,4-bis{[(3-ethyl-3-oxetanyl) methoxy]methyl}benzene, 3-ethyl-3-(phenoxymethyl) oxetane, di[1-ethyl(3-oxetanyl)]methyl ether, 3-ethyl-3-(2-ethylhexyloxymethyl)oxetane, 3-ethyl-3-{[3-(triethoxysilyl)propoxy]methyl}oxetane, oxetanylsilsesquioxane, and phenol novolak oxetane.

(Other Cation Polymerizable Compounds)

Examples thereof include oxolane compounds such as tetrahydrofuran and 2,3-dimethyltetrahydrofuran; cyclic acetal compounds such as trioxane, 1,3-dioxolane, and 1,3,6-trioxanecyclooctane; cyclic lactone compounds such as β-propiolactone and ϵ-caprolactone; thiirane compounds such as ethylenesulfide and thioepichlorohydrin; thiethane compounds such as 1,3-propyne sulfide, and 3,3-dimethylthiethane; cyclic thioether compounds such as tetrahydrothiophene derivatives; and spiro orthoester compounds each obtained by reacting an epoxy compound with lactone.

At least one selected from these cation polymerizable type photocurable compounds may be used, or two or more selected therefrom may be used in the form of a mixture.

(Cation Polymerization Initiator)

An optically acid-generating agent that is ordinarily used for cation polymerization is usable as the photopolymerization initiator. An example thereof is a double salt, onium salt, which can emit a Lewis acid, or a derivative thereof.

An example of the onium salt is a salt composed of: a cation in which organic groups (at least one thereof has an aromatic ring) are bonded to an atom or atomic group selected from the group consisting of S, N, Se, Te, P, As, Sb, Bi, O, I, Br, Cl, F and N═N; and any one anion selected from tetrafluoroborate $(BF_4)^-$, tetrakis(pentafluorophenyl) borate $(B(C_6H_5)_4)^-$, hexafluorophosphate $(PF_6)^-$, hexafluoroantimonate $(SbF_b)^-$, hexafluoroarsenate $(AsF_6)^-$, and hexachloro antimonate $(SbCl_6)^-$.

A sulfonated compound, which generates a sulfonic acid, a halogenated compound, which generates a hydrogen halide, or an iron allene complex is also usable as the cation photopolymerization initiator.

The ink may optionally contain a coloring agent. The coloring agent in the ink may be a known inorganic pigment or organic pigment. The pigment may be a substance having the same structure as the pigment used in the aqueous ink.

For the pigment, a pigment dispersing agent is used which is dispersible in an oil phase to improve the dispersibility of the pigment, this situation being different from that of the aqueous ink.

The pigment dispersing agent may be a polyamide-based resin, a hydroxyl group-containing carboxylate, a salt of a long-chain polyaminoamide and a high molecular weight acid ester, a salt of a high molecular weight polycarboxylic acid, a salt of a long-chain polyaminoamide and a polar acid ester, a high molecular weight unsaturated acid ester, a modified polyurethane, a modified polyacrylate, a polyether-ester type anionic activator, a naphthalenesulfonic acid formalin condensed salt, an aromatic sulfonic acid formalin condensed salt, a polyoxyethylene alkyl phosphate, a polyoxyethylene nonyl phenyl ether, or stearyl amineacetate. The pigment dispersing agent is preferably a polyester polyamide resin having a number average molecular weight of 700 to 15000. The blend proportion of the pigment dispersing agent is preferably from 0.1 to 15% by mass, more preferably from 0.5 to 10% by mass of the ink composition to improve the dispersibility of the pigment.

Examples of such a dispersing agent include SOLSPERSEs 32000, 32500, 32600, 33500, 34750, 35100, and 37500 manufactured by the Lubrizol Corp., and BYK9077 manufactured by BYK-Chemie GmbH.

If necessary, the following may be used: a polymerization inhibitor such as 4-methoxy-1-naphthol, methylhydroquinone, hydroquinone, t-butylhydroquinone, di-t-butylhydroquinone, methoquinone, 2,2'-dihydroxy-3,3'-di(α-methylcyclohexyl)-5,5'-dimethyldiphenymethane, p-benzoquinone, di-t-butyldiphenylamine, phenothiazine, 9,10-di-n-butoxyanthracene, 4,4'-[1,10-dioxo-1,10-decanediylbis(oxy)]bis[2,2,6,6-tetramethyl]-1-piperidinyloxy; a surfactant of a higher fatty acid type, a silicone type or a fluorine-containing type, or any other type; or a polar group-containing polymeric pigment dispersing agent.

When the photopolymerization initiator, monomer and coloring agent each detailed above, and other components are blended with each other for producing ink, the resultant ink may be too high in viscosity to be easily ejected as an ink-jetting ink. In this case, it is advisable to use a solvent to dilute the ink.

The diluting solvent is preferably a solvent having a boiling point in the range of 160 to 190° C. If the boiling point is higher than 200° C., the solvent hinders the curability of the ink. If the boiling point is 150° C. or lower, the ink may be dried to be hardened inside the nozzles of the ink-jet head.

Examples of the solvent include various known solvents such as ethers, ketones, aromatic hydrocarbons, xylene, ethyl ethoxypropionate, ethyl acetate, cyclohexanone, diethylene glycol monomethyl ether, diethylene glycol, monoethyl ether, γ-butyrolactone, ethyl lactate, cyclohexane, methyl ethyl ketone, toluene, ethyl ethoxypropionate, polymethacrylate or propylene glycol monomethyl ether acetate, ethylene glycol monomethyl ether, diethylene glycol, or triethylene glycol monobutyl ether.

The energy ray curable type composition of the ink used in this embodiment has the above-mentioned structure, and the viscosity of the whole of the ink composition ranges from 3 to 40 mPa·s, preferably from 3 to 35 mPa·s at 25° C., or ranges 7 to 15 mPa·s, preferably from 10 to 12 mPa·s at 60° C.

The respective viscosities at 25° C. and 60° C. are measured under the condition that the temperature of constantly-temperature circulating water is set to 25° C. and 60° C., using a cone-plate type rotary viscometer, VISCOMETER TV-22, manufactured by Toki Sangyo Co., Ltd. For adjusting the temperature of the circulating water, an instrument VISCOMATE VM-150 III is used. The temperature of 25° C. has been set on the assumption that the temperature is equivalent to room temperature of an ordinary environment. The temperature of 60° C. has been set on the assumption that the temperature is matched with the specification of a heatable and commercially available ink-jet ejection head, such as a head, GEN 4, manufactured by Ricoh Printing Systems. Ltd.

The static surface tension of this ink composition ranges usually from 20 to 40 mN/m, preferably from 28 to 35 mN/m at 25° C. The static surface tension is measured at 25° C., using a static surface tension meter (model: CBVP-Z, manufactured by Kyowa Interface Science Co., Ltd.). This static surface tension has been set on the assumption that the tension is matched with the specification of a heatable and commercially available ink-jet ejection head, such as a head, GEN 4, manufactured by Ricoh Printing Systems, Ltd.

When the coloring agent is made of an inorganic pigment or organic pigment, the average primary particle size of particles of the pigment ranges from 20 to 200 nm, particularly preferably from 50 to 160 nm. If the average primary particle size is less than 20 nm, the particles are fine so that the resultant printed matter may lack in light resistance. If the average primary particle size is more than 200 mm, the printed matter may lack in minuteness. The average primary particle size is a value measured using an electron microscope (JEM-2010, manufactured by JEOL Ltd.).

<<Oily Ink>>

The oily ink usable in this embodiment contains an organic solvent, a pigment, a dispersing agent, and other additives. The pigment and the dispersing agent may be the same as used for the UV ink.

The organic solvent is not limited to any ester solvent or alcohol solvent, and may be, for example, a hydrocarbon solvent, a higher fatty acid solvent, an ether, or some other organic solvent.

These solvents are usable alone or in the form of a mixture of two or more thereof.

Examples of the ester solvent include methyl laurate, isopropyl laurate, isopropyl myristate, isopropyl palmitate, isooctyl palmitate, isostearyl palmitate, methyl oleate, ethyl oleate, isopropyl oleate, butyl oleate, methyl linoleate, isobutyl linoleate, ethyl linoleate, isopropyl isostearate, methyl soybean oil, isobutyl soybean oil, methyl tall oil, isobutyl tall oil, diisopropyl adipate, diisopropyl sebacate, diethyl sebacate, propylene glycol monocaprate, trimethylolpropane tri-2-ethylhexanoate, and glyceryl tri-2-ethylhexanoate.

Examples of the alcohol solvent include isomyristyl alcohol, isopalmityl alcohol, isostearyl alcohol, and oleyl alcohol. Examples of the higher fatty acid solvent include isononanoic acid, isomyristic acid, isopalmitic acid, oleic acid, and isostearic acid.

Examples of the hydrocarbon solvent include aliphatic hydrocarbon solvents, alicyclic hydrocarbon solvents, and aromatic hydrocarbon solvents.

Examples of the aliphatic hydrocarbon solvents and alicyclic hydrocarbon solvents include TECLEANs N-16, N-20, and N-22, No. 0 SOLVENT L, No. 0 SOLVENT M, No. 0 SOLVENT H, AF-4, AF-5, AF-6, and AF-7, which are each a trade name, manufactured by Nippon Oil Corp.; NISSEKI ISOZOL and NAPHTESOL, which are each a trade name, manufactured by Nippon Petrochemicals Co., Ltd.; Isopar Q, Isopar H, Isopar L, Isopar M, Exxol D40, Exxol D80, Exxol D95, Exxol D110, and Exxol D130 manufactured by Exxon Mobil Corp.

Examples of the higher fatty acid solvent include nonanoic acid, isononanoic acid, isomyristic acid, hexadacanoic acid, isopalmitic acid, oleic acid, and isostearic acid.

Examples of the ether-based solvent include diethyl glycol monobutyl ether, ethylene glycol monobutyl ether, propylene glycol monobutyl ether, and propylene glycol dibutyl ether.

The addition proportion of the organic solvent is preferably 60% or more by mass of the whole of the ink, more preferably from 70 to 98% by mass thereof.

<<Solvent Ink>>

The solvent ink usable in this embodiment contains an organic solvent, a pigment, a pigment dispersing agent, a binder resin, additives, and others. The organic solvent may be a volatile organic solvent usable in ordinary solvent inks.

Examples of the organic solvent include the following:

Alcohols: methyl alcohol, ethyl alcohol, n-propyl alcohol, isopropylene glycol, n-butyl alcohol, tridecyl alcohol, cyclohexyl alcohol, 2-methylcyclohexyl alcohol, and others;

Glycols: ethylene glycol, diethylene glycol, triethylene glycol, polyethylene glycol, propylene glycol, dipropylene glycol, glycerin, and others;

Glycol ethers: ethylene glycol monomethyl ether, ethylene glycol monoethyl ether, ethylene glycol monobutyl ether, ethylene glycol diethyl ether, ethylene glycol dimethyl ether, diethylene glycol monomethyl ether, diethylene glycol monoethyl ether, diethylene glycol monobutyl ether, diethylene glycol ethyl methyl ether, diethylene glycol dimethyl ether, diethylene glycol diethyl ether, diethylene glycol dibutyl ether, propylene glycol monomethyl ether, propylene glycol monoethyl ether, propylene glycol monobutyl ether, dipropylene glycol monomethyl ether, dipropylene glycol monoethyl ether, propylene glycol dimethyl ether, dipropylene glycol dimethyl ether, propylene glycol diethyl ether, dipropylene glycol diethyl ether, ethylene glycol monomethyl acetate, ethylene glycol monoethyl acetate, ethylene glycol monobutyl acetate, diethylene glycol monomethyl acetate, ethylene glycol monomethyl ether acetate, ethylene glycol monoethyl ether acetate, ethylene glycol monobutyl ether acetate, diethylene glycol monoethyl acetate, diethylene glycol monobutyl acetate, triethylene glycol monobutyl ether, ethylene glycol diacetate, diethylene glycol diacetate, triethylene glycol diacetate, propylene glycol diacetate, dipropylene glycol diacetate, 1,4-butylene glycol diacetate, 1,3-butylene glycol diacetate, 1,5-pentadiol diacetate, propylene glycol monomethyl ether acetate, propylene glycol monoethyl ether acetate, propylene glycol monopropyl ether acetate, propylene glycol monobutyl ether acetate, dipropylene glycol monomethyl ether acetate, dipropylene glycol monoethyl ether acetate, dipropylene glycol monopropyl ether acetate, dipropylene glycol monobutyl ether acetate, and others;

Esters: ethyl acetate, isopropyl acetate, n-butyl acetate, methyl lactate, ethyl lactate, butyl lactate, and others;

Ketones: acetone, methyl ethyl ketone, methyl isobutyl ketone, cyclohexanone, isophorone, diacetone alcohol, and others;

Aromatic compounds: toluene, xylene, and others; and

Nitrogen-containing compounds: acetonitrile, γ-butyrolactone, γ-valerolactone, N-methyl-2-pyrrolidone, N-ethyl-2-pyrrolidone, and others, An appropriate solvent is selected from these various solvents from the viewpoint of suitability to properties of the head nozzles at the time of printing, safety, and dryability. If necessary, these solvents may be used in the form of a mixture of two or more thereof.

The ink composition for non-aqueous ink-jet printing preferably contains a glycol ether as the organic solvent.

The glycol ether is in particular preferably diethylene glycol monomethyl ether, diethylene glycol monobutyl ether, diethylene glycol dimethyl ether, diethylene glycol ethyl methyl ether, diethylene glycol diethyl ether, diethylene glycol dibutyl ether, dipropylene glycol monomethyl ether, dipropylene glycol dimethyl ether, propylene glycol monomethyl ether acetate, diethylene glycol monoethyl ether acetate, or diethylene glycol monobutyl ether acetate since the glycol ether gives the ink excellent re-solubility in the printer head, adhesiveness onto a non-absorbing substrate, such as a plastic substrate, and dryability.

The binder resin used in the solvent ink is not particularly limited, and may be a resin for a binder that is ordinarily usable for usual ink compositions.

Examples of the resin include polyester resins, acrylic resins, vinyl chloride resins, epoxy resins, phenolic resins, novolak resins, rosin-modified phenolic resins, amino resins such as melamine and benzoguanamine resins, polyamide resins, cellulose ester resins such as cellulose diacetate, cellulose triacetate, nitrocellulose, cellulose nitrate, cellulose propionate and cellulose acetate butyrate, and cellulose ether resins such as methylcellulose, ethylcellulose, benzylcellulose, tritylcellulose, cyanethylcellulose, carboxymethylcellulose, carboxyethylcellulose, and aminoethylcellulose. Preferably, the binder resin contains a polyester resin, acrylic resin, or vinyl chloride resin since the adhesiveness of the ink onto a substrate is improved at the time of printing.

As the polyester resin, both of a saturated polyester resin and an unsaturated polyester resin are usable. The polyester resin is obtained by condensation reaction between a polybasic acid and a polyhydric alcohol. The number average molecular weight of the polyester resin ranges preferably from 1000 to 50000, more preferably from 2000 to 20000.

The acrylic resin may be a resin obtained by copolymerizing ordinarily used radical polymerizable monomers.

Examples of the radical polymerizable monomers include the following:

(Meth)acrylates: methyl acrylate, ethyl acrylate, isopropyl acrylate, n-butyl acrylate, 2-ethylhexyl acrylate, methyl methacrylate, ethyl methacrylate, isopropyl methacrylate, n-butyl methacrylate, isobutyl methacrylate, t-butyl methacrylate, cyclohexyl methacrylate, 2-ethylhexyl methacrylate, and others;

Vinyl compounds: styrene, vinyltoluene, α-methylstyrene, vinyl acetate, vinyl propionate, vinylpyrrolidone, vinyl chloride, vinylidene chloride, vinylidene fluoride, ethyl vinyl ether, isobutyl vinyl ether, and others;

α-Olefin: ethylene, propylene, and others;

Carboxyl group-containing monomers: acrylic acid, methacrylic acid, maleic acid, fumaric acid, itaconic acid, mono-n-butyl maleate, mono-n-butyl fumarate, mono-n-butyl itaconate, crotonic acid, and others;

Hydroxyl group-containing (meth)acrylates: 2-hydroxyethyl(meth)acrylate, 2-hydroxypropyl(meth)acrylate, 3-hydroxypropyl(meth)acrylate, 4-hydroxybutyl(meth)acrylate, (2-hydroxymethyl)ethyl acrylate, (2-hydroxymethyl)butyl acrylate, (4-hydroxymethylcyclohexyl)methyl(meth)acrylate, glycerin mono(meth)acrylate, 2-(meth)acryloyloxyethyl 2-hydroxypropylphthalate, 2-hydroxy-3-phenoxypropyl(meth)acrylate, and others;

Amide group-containing monomers: acrylamide, methacrylamide, maleic amide, diacetoneacrylamide, and others;

Glycidyl group-containing monomers: glycidyl methacrylate, allyl glycidyl ether, and others;

Cyano group-containing monomers: acrylonitrile, methacrylonitrile, and others;

Dienes: butadiene, isoprene, and others;

Hydroxyl-containing allyl compounds: ally alcohol, 2-hydroxyethyl allyl ether, and others;

Tertiary amino group-containing monomers: dimethylaminoethyl methacrylate, diethylaminoethyl methacrylate, and others; and Alkoxysilyl group-containing monomers: vinyltrimethoxysilane, vinyltriethoxysilane, vinyltriisopropoxysilane, vinyltris(β-methoxyethoxy)silane, vinylmethyldimethoxysilane, vinylmethyldiethoxysilane, vinyldimethylmethoxysilane, vinyldimethylethoxysilane, 3-methacryloxylpropyltrimethoxysilane, 3-methacryloxypropyltriethoxysilane, 3-methacryloxypropylmethyldimethoxysilane, 3-methacryloxypropylmethyldiethoxysilane, and others.

A monomer having, in a single molecule thereof, two or more unsaturated bonds are usable, examples thereof including dially phthalate, divinylbenzene, allyl acrylate, and trimethylolpropane trimethacrylate.

These monomers are used alone or in any combination of two or more thereof.

Examples of the vinyl chloride resin include copolymer resins each made from vinyl chloride, and a different monomer such as vinyl acetate, vinylidene chloride, acrylic acid or maleic acid.

The vinyl chloride resin is preferably a vinylchloride/vinyl acetate copolymer resin. The resin preferably has a molecular weight of 30,000 or less.

These resins may be used in combination, and the content by percentage of the resin(s) is preferably from 1 to 20% by mass, more preferably from 1 to 10% by mass.

The coloring agent of the ink is not particularly limited, and may be appropriately selected in accordance with the purpose. Examples thereof include yellow, magenta, cyan, and black coloring agents.

When an ink-set in which two or more of these coloring agents are used together to perform recording, multi-colored images can be formed. When an ink-set in which all of the coloring agents are used together to perform recording, full-color images can be formed.

Specific working examples in this embodiment, and comparative examples were performed; and then thereabout, experiments for evaluation were made. The following will describe a method for producing samples thereof, and methods for the evaluation.

(Examples of Producing Surface Treatment Film)

Surface treatment films were each formed onto a sample for peeling test, as well as on a sample for ink solubility test. The surface treatment films were each a film in which Al, Zr, Ta, Ti and W were introduced into a $SiO_2$ film. In the films, the element ratio between Si and Al, Zr, Ta, Ti and W was varied to evaluate the films. In a method for forming each of the films, a multi-target sputtering method was used, and respective targets of Si and Al, Zr, Ta, Ti and W were set. Powers for the respective targets were changed to adjust the element ratio, so that members were each produced in which the blend ratio between the elements was varied. In Table 1, shown are the respective compositions of the surface treatment films (the proportion of each of the elements in each of the oxide films).

TABLE 1

| Element (at %) | Ionic Radius | Composition Example 1 | Composition Example 2 | Composition Example 3 |
|---|---|---|---|---|
| Zr | Zr4 + 80 | — | — | — |
| Ta | Ta5 + 76 | — | — | — |
| Ti | Ti4 + 68 | — | — | — |
| W | W6 + 66 | — | — | 10% |
| Al | Al3 + 50 | — | 10% | — |
| Si | Si4 + 41 | 33% | 25% | 17% |

| Element (at %) | Ionic Radius | Composition Example 4 | Composition Example 5 | Composition Example 6 |
|---|---|---|---|---|
| Zr | Zr4 + 80 | — | 2% | 5% |
| Ta | Ta5 + 76 | — | — | — |
| Ti | Ti4 + 68 | 10% | — | — |
| W | W6 + 66 | — | — | — |
| Al | Al3 + 50 | — | — | — |
| Si | Si4 + 41 | 23% | 32% | 28% |

| Element (at %) | Ionic Radius | Composition Example 7 | Composition Example 8 | Composition Example 9 |
|---|---|---|---|---|
| Zr | Zr4 + 80 | 10% | 15% | 20% |
| Ta | Ta5 + 76 | — | — | — |
| Ti | Ti4 + 68 | — | — | — |
| W | W6 + 66 | — | — | — |
| Al | Al3 + 50 | — | — | — |
| Si | Si4 + 41 | 23% | 18% | 13% |

| Element (at %) | Ionic Radius | Composition Example 10 | Composition Example 11 | Composition Example 12 |
|---|---|---|---|---|
| Zr | Zr4 + 80 | — | — | — |
| Ta | Ta5 + 76 | 2% | 5% | 10% |
| Ti | Ti4 + 68 | — | — | — |
| W | W6 + 66 | — | — | — |
| Al | Al3 + 50 | — | — | — |
| Si | Si4 + 41 | 31% | 27% | 21% |

TABLE 1-continued

| Element (at %) | Ionic Radius | Composition Example 13 | Composition Example 14 |
|---|---|---|---|
| Zr | Zr4 + 80 | — | — |
| Ta | Ta5 + 76 | 15% | 20% |
| Ti | Ti4 + 68 | — | — |
| W | W6 + 66 | — | — |
| Al | Al3 + 50 | — | — |
| Si | Si4 + 41 | 16% | 10% |

(Production Examples of Ink-Jetting Ink)

<Preparation of Polymer Solution A>

The inside of a 1-L flask equipped with a mechanical stirrer, a thermometer, a nitrogen gas-introducing tube, a condenser tube, and a dropping funnel was sufficiently purged with nitrogen gas, and then thereinto were charged 11.2 g of styrene, 2.8 g of acrylic acid, 12.0 g of lauryl methacrylate, 4.0 g of polyethylene glycol methacrylate, 4.0 g of styrene macromer, and 0.4 g of mercaptoethanol. These were mixed with each other, and the temperature of the system was raised to 65° C. Next, into the flask was dropwise added a mixed solution of 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer, 3.6 g of mercaptoethanol, 2.4 g of azobismethylvaleronitrile, and 18 g of methyl ethyl ketone over 2.5 hours. After the dropwise addition, into the flask was dropwise added a mixed solution of 0.8 g of azobismethylvaleronitrile, and 18 g of methyl ethyl ketone over 0.5 hours. The solution was ripened at 65° C. for 1 hour, and thereto was then added 0.8 g of azobismethylvaleronitrile, and further the solution was ripened for 1 hour. After the termination of the reaction, into the flask was added 364 g of methyl ethyl ketone to yield 800 g of a polymer solution having a concentration of 50%.

<Preparation of Water Dispersion of Pigment-Containing Polymer Fine Particle>

The following were sufficiently stirred: 28 g of the polymer solution A; 26 g of C.I. Pigment Blue 15:3; 13.6 g of an aqueous solution of potassium hydroxide having a concentration of 1 mol/L; 20 g of methyl ethyl ketone; and 13.6 g of ion exchange water. A roll mill was used to knead these components. The resultant paste was charged into 200 g of pure water, and then the resultant was sufficiently stirred. Thereafter, an evaporator was used to distil off methyl ethyl ketone and water therefrom so that a water dispersion of a cyan polymer fine particle in which the pigment content by percentage was 20% was yielded.

<Preparation of Pigment Resin Dispersion Liquid>

The following were stirred: 7.7 g of a substance, JONCRYL 679 (manufactured by BASF Corp.; molecular weight: 7000; and acid value: 200); 22.5 g of triethanolamine; 0.8 g of 2-propanol; and 331 g of water. In this way, these components were made into a homogeneous state that the solid component was dissolved. Thereinto was incorporated 155 g of C.I. Pigment Blue 15:3 while the solution was stirred. The pigment was then dispersed in a bead mill for 2 hours. Thereto was added 483 g of pure water, and a super centrifugal separator was used to remove coarse particles therefrom so that a blue pigment dispersion liquid in which the pigment content by percentage was 15.5% was yielded.

Each ink was produced through a process described below. However, the ink-producing process is not limited to this process. First, wetting agents, a permeating agent, a surfactant, and water were mixed with one another, and the mixture was stirred for 1 hour to mix these components with one another into a homogenous state. To this mixed liquid were added a coloring agent and an antifoaming agent. The resultant was then stirred for 1 hour. This dispersion liquid was filtrated through a 0.8-μ cellulose acetate membrane filter under increased pressure to remove coarse particles and dust therefrom. In this way, each ink used for evaluation was yielded.

The composition of each of the inks is shown in Table 2. Each of the inks prepared by the above-mentioned method was used as an ink for evaluation.

TABLE 2

| | | | Preparation Examples | | | |
|---|---|---|---|---|---|---|
| | | | 15 | 16 | 17 | 18 |
| Coloring agents | | Bayscript Black SP liquid, manufactured by LANXESS | | 28.3 | | |
| | | Water dispersion of pigment-containing polymer fine particles | | | 25.0 | 20.0 |
| | | Pigment resin dispersion liquid | 25.8 | | | |
| Solvents | Amide-based wetting agents | N-methyl-2-pyrrolidone | 25.0 | | | |
| | | 2-Pyrrolidone | | 5.0 | 15.0 | |
| | | 3-Dimethyl-2-imidazolydinone | | 5.0 | 10.0 | |
| | | Compound 1 | | 20.0 | | 30.0 |
| | Alcohol-based wetting agents | Glycerin | 10.0 | 5.0 | 10.0 | 10.0 |
| | | 1,3-Butanediol | 5.0 | 10.0 | 5.0 | 10.0 |
| | Permeating agents | 1,2-Hexanediol | 2.0 | | 4.0 | |
| | | Octanediol | | 2.0 | | 2.0 |
| Surfactants | | EMULGEN LS-106 | | 0.5 | 1.0 | |
| | | BYK-348, manufactured by BYK-Chemie GmbH | 1.0 | | | 0.5 |
| | | Water | 31.2 | 24.2 | 30.0 | 27.5 |
| Total | | | 100.0 | 100.0 | 100.0 | 100.0 |

(Production Examples of Epoxy Adhesive Agent)

At room temperature, 40 parts of a modified aliphatic amine as a curing agent and 10 parts of a silica filler as a thixotropy supplier were added to 20 parts of a liquid bisphenol A as a main agent, 30 parts of a trifunctional aminophenol type epoxy resin and 50 parts of a dicyclopentadiene structure-containing epoxy resin (HP 7200, manufactured by DIC Corp.). This mixture was kneaded at a low temperature and subdivided bit by bit, and kept in a freezer. Whenever the mixture was used, the subdivided fractions were unfrozen and used.

(Evaluation Methods for Surface Treatment Film)

Conditions for bonding the film, and others are described in each of Examples and Comparative Examples.

(i) Initial Adhesiveness

The initial adhesiveness of each of these examples was evaluated in a peeling strength test.

Peeling Test: A Si monocrystal having a width of 17 m and a thickness of 400 μm was processed to obtain Si substrates in each of which slits each having a width of 140 μm and a length of 2000 μm were made at a pitch of 150 dpi, groups of the slits were arranged into 4 rows, and positions of the slits were arranged to be shifted from each other at a pitch of 42.3 μm. The surface treatment film of each of Examples and Comparative Examples was formed on any one of these Si substrates (bonding area proportion: 64.7%). Onto the bonding surface of the resultant member, the epoxy adhesive agent was coated to give a coated film thickness of 2.5 μm. The sample in which the surface treatment film of each of Examples and Comparative Examples was formed was put onto a rolled SUS flat plate made of SUS 304 and having a width of 19 mm and a thickness of 20 μm, and then the resultant was heated at 80° C. for 3 hours while pressed under a pressure of 10 cN·m. In this way, the adhesive agent was cured to bond the two members to each other. A desktop type material tester (TENSILON STA-1150, manufactured by Orientec Co., Ltd.) was used to peel the sample bonded to the SUS from the SUS over a length of 5 mm at a 90°-direction peeling strength measuring rate of 1 mm/min. The average peeling strength in this case was measured.

The evaluation result was in accordance with the following; A: the strength was 1.2 N or more; B: 1.0 to 1.2 N; C, 0.5 to 1.0 N; and D: less than 0.5 N. A strength of 0.5 N or more (A to C) was required in accordance with a target specification.

(ii) Bonding Reliability

Each of the samples after the peeling strength test was subjected to an ink-resistant test (immersion into ink at 60° C. for 2 months), and then subjected to a peeling test and a tensile strength test.

The sample was peeled over a length of 5 mm at a 90°-direction peeling strength measuring rate of 1 mm/min. The average peeling strength in this case was measured.

The evaluation result was in accordance with the following; A: the strength was 1.2 N or more; B: 1.0 to 1.2 N; C, 0.5 to 1.0 N; and D: less than 0.5 N. A strength of 0.5 N or more (A to C) was required in accordance with a target specification.

(iii) Ink Solubility

The silicon substrate on which the surface treatment film 112 of each of Examples and Comparative Examples was formed into a thickness of 5.0 nm was cut into a rectangular piece having a size of 1 cm×5 cm. This was used as a sample for immersion. This sample was immersed into one of the above-mentioned inks (at 60° C. for 2 months).

The evaluation result was in accordance with the following; A: the thickness of the remaining film was 45 nm or more; B: 25 nm or more; and C: less than 25 nm. In any actual ink-jet head, it does not happen that the surface treatment film 112 on which the adhesive agent is formed contacts ink so that the surface treatment film 112 directly contacts the ink. Thus, this evaluation result was handled as a reference value.

(Evaluation of Ink-Jet Head Ejection)

The surface treatment film 112 of each of Examples was used to join a channel plate and a nozzle plate with each other to form an ink-jet head according to the above-mentioned description. This was used as an ink-jet head for evaluation. The formed ink-jet head was evaluated in accordance with a combination of ink and the surface treatment film 112 that are shown in Table 3 or 4. The following will describe evaluation items of the ink-jet head, and results of the evaluation.

(a) Ink Fillability

A pipe was connected to the ink-jet head so that the ink could be supplied to the head. The head was sucked from the nozzle face side thereof at 50 kPa for 1 minute, and then the head face was maintained. From the head, the ink was ejected by generating appropriate negative pressure. An evaluation was made to the ejection ratio (the number of ejection nozzles/the number of the entire nozzles×100) at this time. The evaluation result was in accordance with the following; A: the ejection ratio was 98% or more; B: 90% or more; and C: less than 90%. A ratio of 98% (A) was required in accordance with a target specification.

(b) Ink-Resistant Reliability

The ink-jet head filled with the ink was allowed to stand at 60° C. for 3 months. After the standing, the ejection speed of the ink was evaluated. The evaluation result was in accordance with the following; A: the ejection speed of all the nozzles satisfied a value less than ±5% of the average value before the standing; B: a value less than ±10% of the average value; and C: a value outside ±10% of the average value. A value less than ±10% of the average value (A and B) was required in accordance with a target specification.

Table 3 shows the evaluation results of Examples 1 to 12 as cases where the composition of the surface treatment film 112 was varied into composition from Composition 1 to Composition 14. Table 4 shows the evaluation results of Examples 13 to 15 as cases where the ink-resistant test was made using, for Composition Example 11, an ink from Ink Example 16 to Ink Example 18.

TABLE 3

| | Comparative Example 1 | Comparative Example 2 | Example 1 |
|---|---|---|---|
| Example of surface treatment film | Composition Example 1 | Composition Example 2 | Composition Example 3 |
| Example of ink | Preparation Example 15 | Preparation Example 15 | Preparation Example 15 |
| Initial adhesiveness | A | B | B |
| Bonding reliability | D | D | C |
| Ink solubility | C | C | C |
| Ink fillability | A | A | A |
| Ink-resistant reliability | C | C | B |

| | Example 2 | Example 3 | Example 4 |
|---|---|---|---|
| Example of surface treatment film | Composition Example 4 | Composition Example 5 | Composition Example 6 |
| Example of ink | Preparation Example 15 | Preparation Example 15 | Preparation Example 15 |
| Initial adhesiveness | B | A | A |
| Bonding reliability | C | B | A |
| Ink solubility | C | B | A |
| Ink fillability | A | A | A |
| Ink-resistant reliability | B | B | A |

TABLE 3-continued

| | Example 5 | Example 6 | Example 7 |
|---|---|---|---|
| Example of surface treatment film | Composition Example 7 | Composition Example 8 | Composition Example 9 |
| Example of ink | Preparation Example 15 | Preparation Example 15 | Preparation Example 15 |
| Initial adhesiveness | A | B | C |
| Bonding reliability | A | B | C |
| Ink solubility | A | A | A |
| Ink fillability | A | A | A |
| Ink-resistant reliability | A | A | A |

| | Example 8 | Example 9 | Example 10 |
|---|---|---|---|
| Example of surface treatment film | Composition Example 10 | Composition Example 11 | Composition Example 12 |
| Example of ink | Preparation Example 15 | Preparation Example 15 | Preparation Example 15 |
| Initial adhesiveness | A | A | A |
| Bonding reliability | A | A | A |
| Ink solubility | A | A | A |
| Ink fillability | A | A | A |
| Ink-resistant reliability | A | A | A |

| | Example 11 | Example 12 |
|---|---|---|
| Example of surface treatment film | Composition Example 13 | Composition Example 14 |
| Example of ink | Preparation Example 15 | Preparation Example 15 |
| Initial adhesiveness | C | C |
| Bonding reliability | C | C |
| Ink solubility | A | A |
| Ink fillability | A | A |
| Ink-resistant reliability | A | A |

TABLE 4

| | Example 13 | Example 14 | Example 15 |
|---|---|---|---|
| Example of surface treatment film | Composition Example 11 | Composition Example 11 | Composition Example 11 |
| Example of ink | Preparation Example 16 | Preparation Example 17 | Preparation Example 18 |
| Initial adhesiveness | A | A | A |
| Bonding reliability | A | A | A |
| Ink solubility | A | A | A |
| Ink fillability | A | A | A |
| Ink-resistant reliability | A | A | A |

Figure 9:
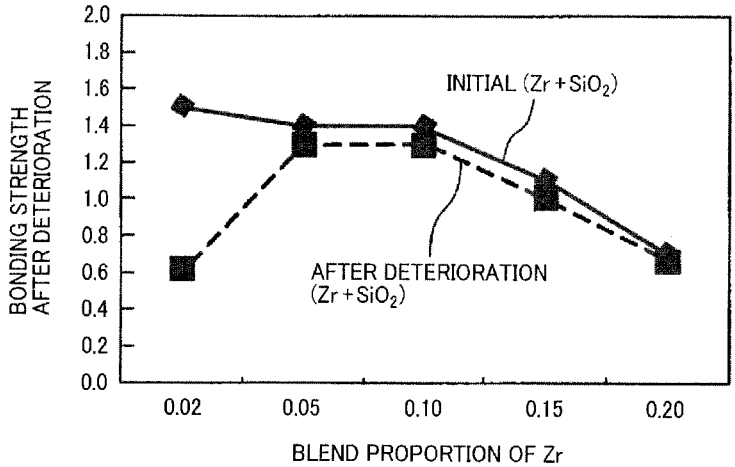
FIG. 9 is a graph of an example of a change in the bonding strength of a Zr-containing $SiO_2$ film before and after a deterioration test thereof.
Figure 10:
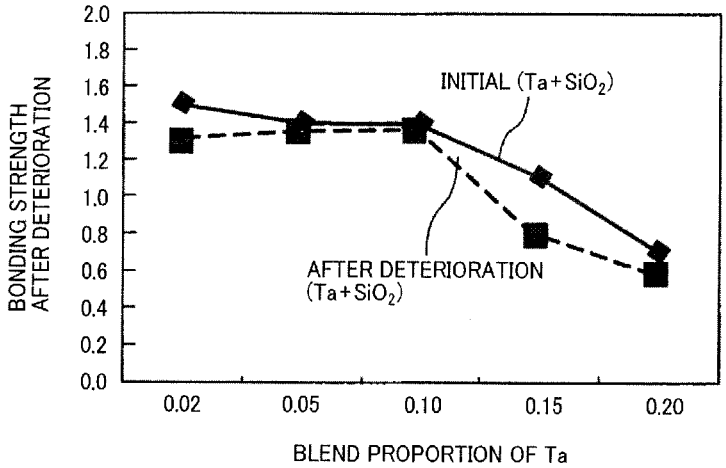
FIG. 10 is a graph of an example of a change in the bonding strength of a Ta-containing $SiO_2$ film before and after a deterioration test thereof.

FIGS. 9 and 10 show respective bonding strength change of the Zr-containing $SiO_2$ film and the Ta-containing $SiO_2$ film before and after the deterioration test.

According to the above-mentioned results, in Comparative Examples 1 and 2, their initial adhesiveness satisfies the target specification, but the bonding reliability is low and the ink-resistant reliability does not satisfy the target specification, either. As is also evident from the results of the ink solubility, this is because their surface treatment film 112 is dissolved with the ink so that interfaces of bonding portions of partitions of the Si member are corroded, whereby effective bonding portions are deceased or lost to lower the head in strength.

The decrease of the bonding portions makes the channel portions low in rigidity, so that the ink-flowing channels are also largely lowered in pressure, whereby the ejection reliability of the head is also largely deteriorated.

As is understood from the results of Examples 1 and 2, the bonding reliability and the ink-resistant reliability are improved from Comparative Example 1 only by introducing Ti or W in a small proportion into a $SiO_2$ film.

FIG. 9 shows numerical values of the bonding reliability (the bonding strength after the deterioration) in the case of the incorporation of Zr in Examples 3 to 7. In the same way as described above, the bonding reliability and the ink-resistant reliability are largely improved only by introducing Zr in a proportion of about 5%. However, from FIG. 9, it is understood that the numerical values of the bonding strength after the deterioration has a certain peak, following the change in the Zr blend proportion.

As is evident from the results of Examples 6 and 7, this is because Zr is lower in adhesiveness than $SiO_2$; thus, as the Zr blend proportion is made larger, the numerical value of the bonding strength is lowered at the initial bonding stage, so that the bonding strength after the deterioration is also lowered.

In the case of Zr, the blend proportion thereof is preferably from about 5 to 10 atomic % in order to allow the surface treatment film to have both of initial adhesiveness and bonding reliability and heighten the film in ink-resistant reliability.

FIG. 10 shows numerical values of the bonding reliability (the bonding strength after the deterioration) in the case of the incorporation of Ta in Examples 8 to 12. In the same way as described above, the bonding reliability and the ink-resistant reliability are largely improved only by introducing Ta in a slight proportion of about 2 atomic %. However, from FIG. 10, it is understood that the numerical values of the bonding strength after the deterioration has a certain peak, following the change in the Ta blend proportion. This is based on the same reason as in Zr.

Since Ta is more strongly bonded to O than Zr, a stable passive film can be formed, so that the Ta-containing film is very high in resistance against being dissolved with ink. At a Ta proportion of 2 atomic % or more, the film is not dissolved at all even after subjected to the deterioration test for 2 months.

However, Ta is lower in adhesiveness than $SiO_2$ and Zr since Ta forms a stable passive film. Thus, the initial strength is also decreased as the blend proportion thereof is increased. In the case of Ta, the blend proportion is preferably from about 2 to 10 atomic % to allow the channel-forming members to ensure sufficient joining strength after the members contact ink liquid.

Incidentally, in FIGS. 9 and 10, the surface treatment film 112 in which the content by percentage of each of Ta and Zr is 2 atomic % is larger in numerical values of initial adhesiveness and bonding strength than the surface treatment film 112 in which that is 5 atomic % or more. As the composition of the film is closer to that of a $SiO_2$ film, the numerical values are larger. This demonstrates that a film having composition closer to that of a $SiO_2$ film can ensure higher adhesiveness. However, the film becomes lower in ink-resistance.

The following will describe a second embodiment of the present invention for eliminating tradeoff relationship between the adhesiveness and the ink-resistant reliability.

In a first example thereof, only in the topmost surface side (the interface with the adhesive agent) of the surface treatment film 112 that contacts the adhesive agent 113, the blend proportion of Si is made high. At the inside of the surface treatment film 112, the blend proportion of Ta or Zr is made higher than in the topmost surface.

Figure 11:
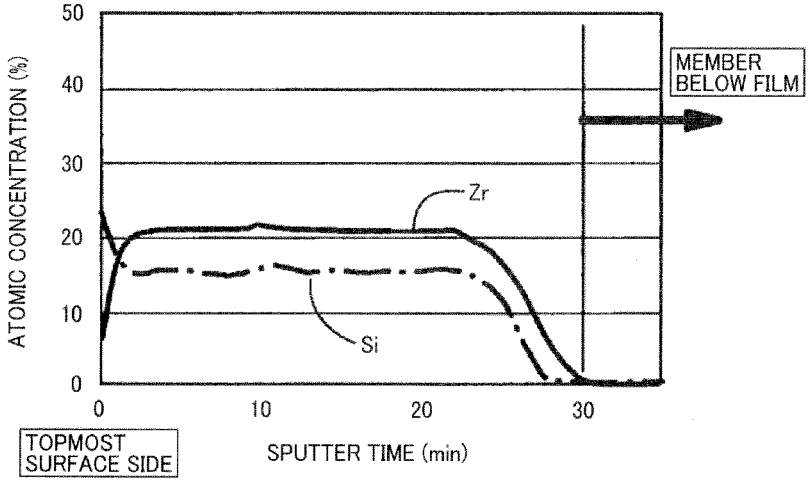
FIG. 11 is a graph of an example of a second embodiment of the present invention, the graph showing a result obtained by measuring the composition of elements from the topmost surface of a surface treatment film in this example toward a member below the film (channel-forming member) according to a depth profile.

FIG. 11 shows an example of a result obtained by using X-ray photoelectron spectroscopy (XPS) to measure the composition of elements from the topmost surface of the surface treatment 112 film toward a member below the film (channel-forming member) according to a depth profile. In this example, only Zr is used as an example. However, substantially the same results are also obtained with other metals.

As shown in FIG. 11, the surface treatment film 112 is formed in such a manner that the blend proportion of Si is high only in the topmost surface thereof.

A method useful for forming the surface treatment film 112 is an ALD method or a sputtering (PVD) method. The ALD method adopts a manner of forming $SiO_2$ films, and $TaO_x$ or $ZrO_x$ films alternately whenever several steps are performed. Thus, by changing the ratio between the actual numbers of the steps, the film quality can easily be controlled. In the sputtering (PVD) method, plural targets of Si, and Zr and Ta may be used. By changing powers applied to the respective targets, the film quality can be controlled.

As described above, in the surface treatment film, the blend ratio of Si to the transition metal(s) is made higher in the topmost surface side (the interface with the adhesive layer) of the surface treatment film 112 that contacts the adhesive agent 113 than at the inside of the surface treatment film, whereby the presence proportion of $SiO_2$ can be improved in the interface. Thus, Si—O bonds are increased so that Si—OH groups are generated in a larger amount and the wettability of the film onto the adhesive agent 113 is improved. As a result, the surface treatment film is improved in adhesiveness onto the adhesive agent, in particular, the adhesive agent 113 in which a silane coupling agent or an amine-based curing agent is used, and further has ink-resistant reliability.

In a second example, for eliminating the tradeoff relationship between the adhesiveness and the ink-resistant reliability in the same way, the blend proportion of O is made high only in the topmost surface side (the interface with the adhesive layer) of the surface treatment film 112.

Figure 12:
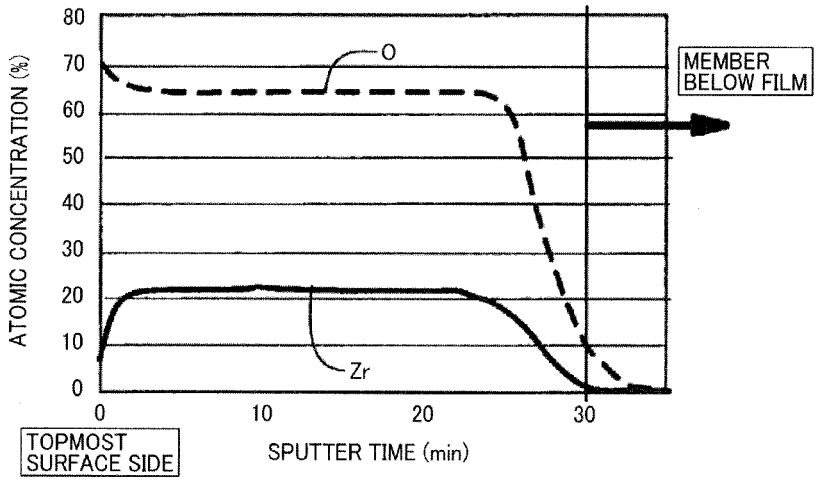
FIG. 12 is a graph of another example of the second embodiment, the graph showing a result obtained by measuring the composition of elements from the topmost surface of a surface treatment film in the example toward a member below the film (channel-forming member) according to a depth profile.

FIG. 12 shows a result obtained by using XPS (X-ray photoelectron spectroscopy) to measure the composition of elements from the topmost surface of the surface treatment 112 film toward a member below the film (channel-forming member) according to a depth profile. In this example, only Zr is used as an example. However, substantially the same results are also obtained with other metals.

As shown in FIG. 12, the surface treatment film 112 is formed in such a manner that the blend proportion of O is high only in the topmost surface thereof A method useful for forming the surface treatment film 112 is an ALD method as well. A gas which is caused to react with a source gas is generally $O_2$ plasma or $H_2O$. By controlling the quantity of this reactive gas, the O proportion can be made high only in the topmost surface.

When the O blend proportion is made high, the topmost surface is made into an oxidized film up to a higher degree so that the concentration of hydrogen bonds therein becomes higher. Thus, the bonding strength is improved.

As described above, in the surface treatment film 112, the blend ratio of O to the transition metal(s) is made higher in the adhesive agent 113 surface side (the interface with the adhesive layer) of the surface treatment film 112 than at the inside of the surface treatment film 112, whereby the concentration of OH groups becomes higher in the surface of the surface treatment film of the adhesive agent 113 side. Thus, an improvement in the adhesiveness can be expected by the hydrogen bonds. In the blend ratio between O and the transition metal(s) at the inside of the surface treatment film 112, the metal proportion is higher at the inside than in the topmost surface, so that the surface treatment film 112 can ensure ink-resistant reliability.

The following will describe a third embodiment of the present invention for improving the adhesiveness between the surface treatment film 112 and the channel-forming members.

Figure 13:
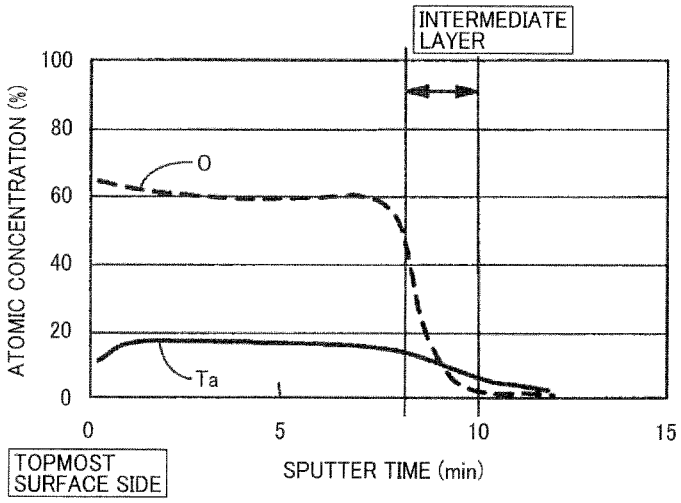
FIG. 13 is a graph of an example of a third embodiment of the present invention, the graph showing a result obtained by measuring the composition of elements from the topmost surface of a surface treatment film in the example toward a member below the film (channel-forming member) according to a depth profile.

In a first example, the surface of the channel forming member side of the surface treatment film 112 is changed in composition in such a manner that, for example, as shown in FIG. 13, the proportion of O at the member side is lowered.

In this example, transition metals high in bondability with O pull oxygen out from the channel forming member side, thereby making it possible to form an intermediate layer so that the surface treatment film gains high bonding strength.

As described above, the surface treatment film 112 is formed to have a structure in which the blend ratio of O to the transition metal(s) is made lower at the bottommost surface side (the interface with the members) of the surface treatment film 112 than at the inside of the surface treatment film 112, so that the transition metal species high in bondability with O pull(s) oxygen out from the channel-forming members, which are substrates. As a result, an intermediate layer is formed, thereby making it possible to allow the surface treatment film to have ink-resistant reliability while the adhesiveness of the film onto the metal members is improved.

Figure 14:
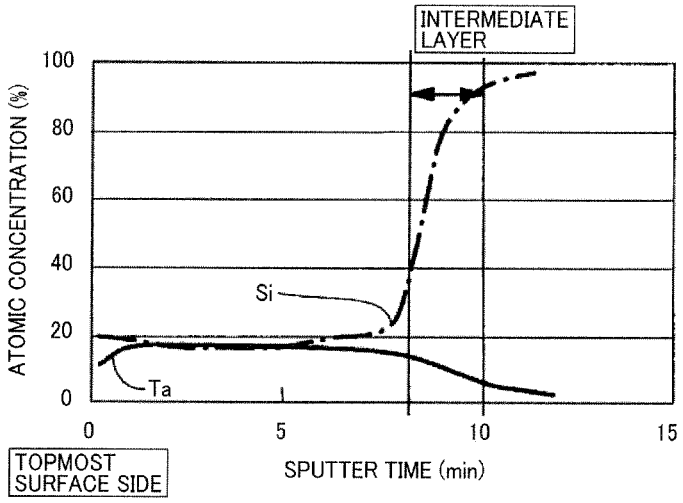
FIG. 14 is a graph of another example of the third embodiment, the graph showing a result obtained by measuring the composition of elements from the topmost surface of a surface treatment film in this example toward a member below the film (channel-forming member) according to a depth profile.

In a second example, the surface of the channel forming member side of the surface treatment film 112 is changed in composition in such a manner that, for example, as shown in FIG. 14, the proportion of Si at the member side is raised.

In this example, the surface treatment film 112 can be made high in adhesiveness onto a substrate of any metal high in compatibility with Si, examples thereof including a Si substrate, a Ni electroplated member, and a SUS member.

As described above, the surface treatment film 112 is formed to have a structure in which the blend ratio of Si to the transition metal(s) is made higher at the bottommost surface side (the interface with the members) of the surface treatment film 112 than at the inside of the surface treatment film 112, so that Si is combined with the members to form an intermediate easily. As a result, Si is intermixed with the members in the interfaces, thereby making it possible to allow the surface treatment film 112 to have ink-resistant reliability while the surface treatment film 112 is made high in adhesiveness onto a metal member, in particular, a Si substrate, a SUS member containing a metal high in compatibility with Si, or a Ni electroplated member.

First, an image forming apparatus according to an embodiment of this disclosure is described below with reference to FIGS. 15 and 16.

Figure 15:
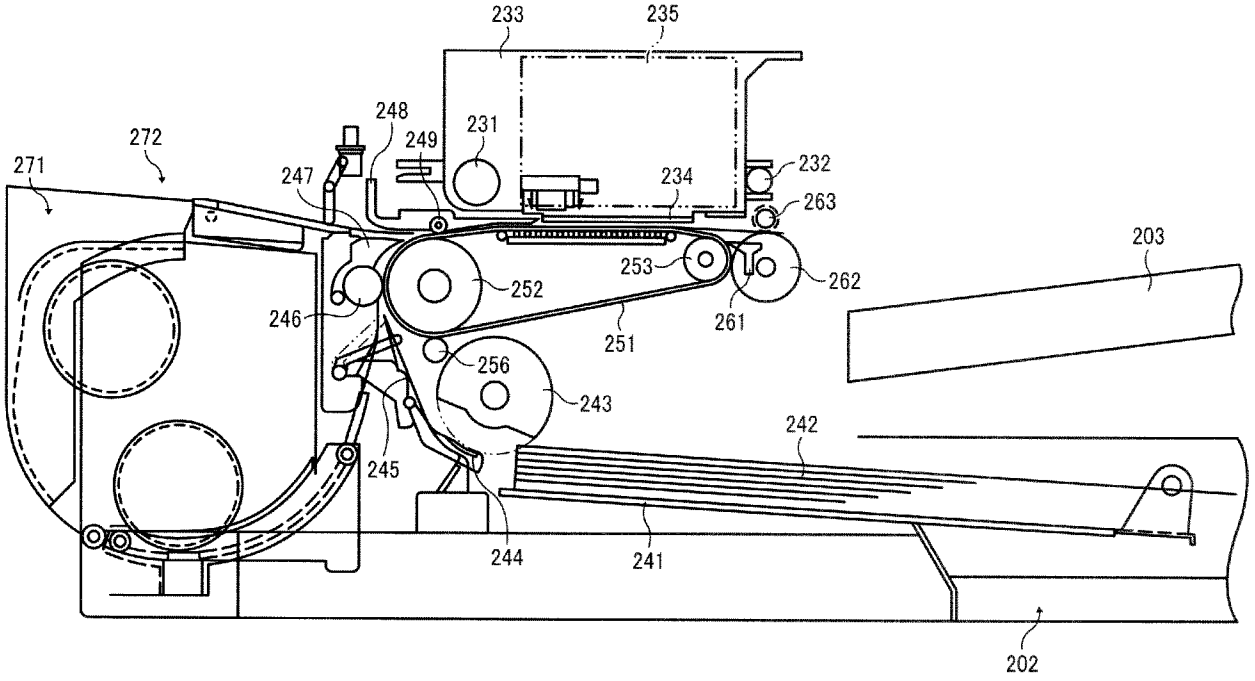
FIG. 15 is a side view of a mechanical section of an image forming apparatus according to an embodiment of the present disclosure.

FIG. 15 is a side view of a mechanical section of an image forming apparatus according to an embodiment of this disclosure. FIG. 16 is a partial side view of the mechanical section illustrated in FIG. 15.

In this embodiment, the image forming apparatus illustrated in FIG. 15 is a serial-type image forming apparatus. In the image forming apparatus, a carriage 233 is supported by a main guide rod 231 and a sub guide rod 232 so as to be movable in a direction (main scanning direction) indicated by arrow MSD in FIG. 16. The main guide rod 231 and the sub guide rod 232 serving as the main guide member and the sub guide member, respectively, extend between a left side plate 221A and a right side plate 221B. A main scanning motor reciprocally moves the carriage 233 for scanning in the main scanning direction MSD via a timing belt.

The carriage 233 mounts recording heads 234 serving as liquid ejection heads according to this embodiment. The recording heads 234 eject, for example, ink droplets of different colors, such as yellow (Y), cyan (C), magenta (M), and black (K). Each of the recording heads 234 is mounted on the carriage 233 so that nozzle rows, each of which includes multiple nozzles, are arranged in a sub scanning direction (indicated by arrow SSD in FIG. 16) perpendicular to the main scanning direction MSD and ink droplets are ejected downward from the nozzles.

Each of the recording head 234 has two nozzle rows. For example, one of two nozzle rows of a recording head 234*a*, which is one of the recording heads 234, ejects droplets of black (k), and the other ejects droplets of cyan (C). One of two nozzle rows of a recording head 234*b*, which is the other of the recording heads 234, ejects droplets of magenta (M), and the other ejects droplets of yellow (Y). In this embodiment, the image forming apparatus has a configuration in which two recording heads eject four colors of liquid droplets. However, it is to be noted that four nozzle rows per head may be arranged to eject four colors of liquid droplets by a single head.

A supply unit replenishes and supplies the four color inks from respective ink cartridges 210 to head tanks 235 of the recording heads 234 via respective supply tubes 236.

The image forming apparatus has a sheet feed section to feed sheets 242 stacked on a sheet stack portion (platen) 241 of a sheet feed tray 202. The sheet feed section further includes a sheet feed roller 243 and a separation pad 244. The sheet feed roller 243 of, e.g., a substantially half moon shape separates the sheets 242 from the sheet stack portion 241 and feeds the sheets 242 sheet by sheet. The separation pad 244 is disposed opposing the sheet feed roller 243 and is made of a material having a high friction coefficient. The separation pad 244 is also biased (urged) toward the sheet feed roller 243.

To feed the sheet 242 from the sheet feed section to an area below the recording heads 234, the image forming apparatus includes a first guide 245 to guide the sheet 242, a counter roller 246, a conveyance guide member 247, a pressure member 248 having a front-end press roller 249, and a conveyance belt 251. The conveyance belt 251 serves as a conveyance member to convey the sheet 42 to a position opposing the recording head assembly 234 with the sheet 242 electrostatically attached thereon.

The conveyance belt 251 is an endless belt looped between a conveyance roller 252 and a tension roller 253 to circulate in a belt conveyance direction (sub-scanning direction SSD). A charging roller 256 serving as a charging device is provided to charge an outer surface of the conveyance belt 251. The charging roller 256 is disposed so as to contact the outer surface of the conveyance belt 251 and rotate with the circulation of the conveyance belt 251. As the conveyance roller 252 is driven for rotation by a sub scanning motor via a timing belt, the conveyance belt 251 is moved to circulate in the belt conveyance direction.

The image forming apparatus further includes a sheet output section to output the sheet 242 having an image formed by the recording heads 234. The sheet output section includes a separation claw 261 to separate the sheet 242 from the conveyance belt 251, a first output roller 262, and a second output roller 263. The sheet output tray 203 is disposed below the first output roller 262.

A dual-side sheet feed unit 271 is detachably mounted on a rear face side of an apparatus body. When the conveyance belt 251 rotates in reverse to return the sheet 242, the dual-side sheet feed unit 271 receives and turns the sheet 242 upside down to feed the sheet 242 between the counter roller 246 and the conveyance belt 251. A bypass tray 272 is disposed at an upper face of the dual-side sheet feed unit 271.

Figure 16:
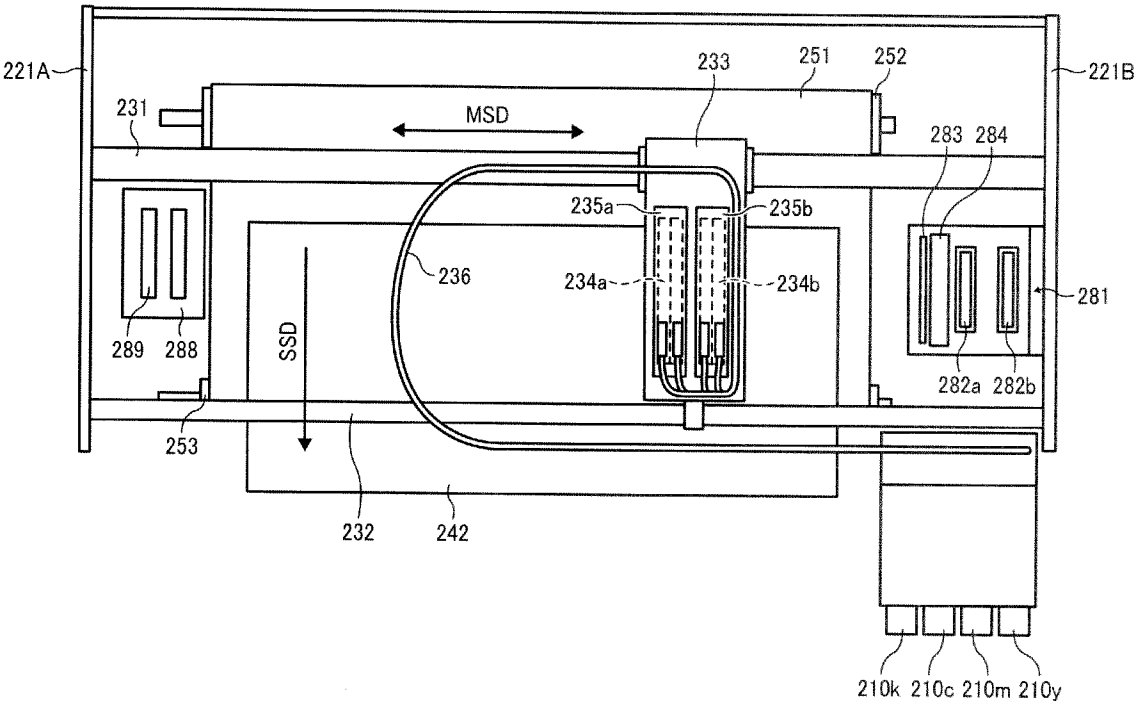
FIG. 16 is a partial plan view of the mechanical section illustrated in FIG. 15.

As illustrated in FIG. 16, a maintenance-and-recovery assembly 281 is disposed at a non-printing area (non-recording area) that is located on one end in the main scanning direction of the carriage 233. The maintenance-and-recovery assembly 281 includes a recovery device to maintain and recover nozzle conditions of the recording heads 34. The maintenance-and-recovery assembly 281 includes caps 282*a* and 282*b*, a wiper blade 283, a first droplet receptacle 284. The caps 282*a* and 282*b* (hereinafter collectively referred to as "caps 92" unless distinguished) cap the nozzle faces of the recording heads 234. The wiper blade 283 is a blade member to wipe the nozzle faces of the recording heads 234. The first droplet receptacle 284 stores ink droplets ejected by dummy ejection in which droplets not contributing to a resultant recorded image is ejected for removing viscosity-increased ink.

As illustrated in FIG. 16, a second dummy ejection receptacle 288 is disposed at a non-printing area on the opposite end in the main scanning direction of the carriage 233. The second dummy ejection receptacle 288 receives liquid droplets ejected, e.g., during recording operation by dummy ejection in which droplets not contributing to image recording are ejected to remove viscosity-increased recording liquid. The second dummy ejection receptacle 288 has openings 289 arranged in parallel to the nozzle rows of the recording heads 234.

In the image forming apparatus having the above-described configuration, sheets 242 are fed sheet by sheet from the sheet feed tray 202. The sheets 242 fed substantially vertically upward are guided along the first guide 245 and conveyed while being sandwiched by the conveyance belt 251 and the counter roller 246. Further, a front end of the sheet 42 is guided by the conveyance guide member 247 and is pressed against the conveyance belt 251 by the front-end pressing roller 249 to turn the transport direction of the sheet 242 by approximately 90°.

At this time, positive and negative voltages are alternately supplied to the charging roller 256. As a result, the conveyance belt 251 is charged in an alternating voltage pattern, that is, so that positively charged areas and negatively charged areas are alternately repeated at a certain width in the sub-scanning direction SSD, i.e., the belt conveyance direction. When the sheet 242 is fed onto the conveyance belt 251 thus charged, the sheet 242 adheres to the conveyance belt 251 and conveyed in the sub scanning direction by the circulation of the conveyance belt 251.

By driving the recording heads 234 in accordance with image signals while moving the carriage 233, ink droplets are ejected onto the sheet 242, which is stopped below the recording heads 234, to form one line of a desired image. Then, after the sheet 242 is fed by a certain distance, the recording heads 234 record another line of the image. Receiving a recording end signal or a signal indicating that the rear end of the sheet 242 has arrived at the printing area, the recording operation finishes and the sheet 242 is output to the sheet output tray 203.

As described above, the image forming apparatus has, as the recording heads, the liquid ejection heads according to this embodiment, thus allowing stable formation of high quality image.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid ejection head, comprising:

channel forming members joined to each other via an adhesive agent forming an adhesive layer, with one channel forming member being above the adhesive layer and another channel forming member being below the adhesive layer in a layering direction, to form a channel for liquid, wherein the adhesive layer is an organic thin film; and a surface treatment film, including at least a portion extending in the layering direction on a surface of at least one of the channel forming members, wherein the surface treatment film is an oxidized film including Si, and the oxidized film further includes a transition metal forming a passive film.

2. The liquid ejection head according to claim 1, wherein the surface treatment film has a higher blend ratio of Si to the transition metal in a surface of the surface treatment film facing the adhesive agent than in an inside of the surface treatment film.

3. The liquid ejection head according to claim 1, wherein the surface treatment film has a higher blend ratio of O to the transition metal in a surface of the surface treatment film facing the adhesive agent than in an inside of the surface treatment film.

4. The liquid ejection head according to claim 1, wherein the surface treatment film has a higher blend ratio of Si to the transition metal in a surface of the surface treatment film facing the at least one of the channel forming members than in an inside of the surface treatment film.

5. The liquid ejection head according to claim 1, wherein the surface treatment film has a lower blend ratio of O to the transition metal in a surface of the surface treatment film facing the at least one of the channel forming members than in an inside of the surface treatment film.

6. The liquid ejection head according to claim 1, wherein the surface treatment film comprises at least one transition metal selected from groups 4 and 5.

7. The liquid ejection head according to claim 1, wherein the surface treatment film includes at least one of Hf, Ta, and Zr.

8. The liquid ejection head according to claim 1, wherein the surface treatment film includes Si in a proportion of 17 atomic % or more.

9. The liquid ejection head according to claim 1, wherein the surface treatment film includes the transition metal in a proportion of 2 atomic % or more.

10. The liquid ejection head according to claim 1, wherein the surface treatment film is a film formed by an atomic layer deposition method.

11. The liquid ejection head according to claim 1, wherein the surface treatment film is a film formed by a physical vapor deposition sputtering method.

12. An image forming device, comprising the liquid ejection head according to claim 1.

* * * * *